US008251276B2

(12) United States Patent
McLeod

(10) Patent No.: US 8,251,276 B2
(45) Date of Patent: Aug. 28, 2012

(54) OCTAGON-SHAPED FOOD-TRANSPORT CONTAINER

(75) Inventor: Michael B McLeod, Romeoville, IL (US)

(73) Assignee: TIN Inc., Austin, TX (US)

( * ) Notice: Subject to any disclaimer, the term of this patent is extended or adjusted under 35 U.S.C. 154(b) by 0 days.

(21) Appl. No.: 13/234,001

(22) Filed: Sep. 15, 2011

(65) Prior Publication Data

US 2012/0000973 A1 Jan. 5, 2012

Related U.S. Application Data

(62) Division of application No. 12/326,045, filed on Dec. 1, 2008, now Pat. No. 8,091,770.

(60) Provisional application No. 61/012,349, filed on Dec. 7, 2007.

(51) Int. Cl.
*B65D 5/28* (2006.01)

(52) U.S. Cl. ..... 229/109; 229/170; 229/174; 229/918; 229/919

(58) Field of Classification Search ..... 229/109, 229/170, 172, 174, 915, 918, 919
See application file for complete search history.

(56) References Cited

U.S. PATENT DOCUMENTS

| | | | | |
|---|---|---|---|---|
| 667,112 | A | 1/1901 | Beers | |
| 2,603,404 | A * | 7/1952 | Eldredge | 229/919 |
| 2,868,430 | A | 1/1959 | Hamilton | |
| 3,118,591 | A | 1/1964 | Allard | |
| 3,545,666 | A | 12/1970 | Visvydas | |
| 3,704,823 | A | 12/1972 | Howe | |
| 3,810,574 | A | 5/1974 | Gardner | |
| 3,871,570 | A | 3/1975 | Garmon | |
| 4,537,344 | A | 8/1985 | Thomas | |
| 4,792,084 | A * | 12/1988 | Dreeszen | 229/109 |
| 4,883,221 | A | 11/1989 | Brundage | |
| 4,911,355 | A | 3/1990 | Bannister | |
| 5,052,615 | A | 10/1991 | Ott et al. | |
| 5,163,609 | A | 11/1992 | Muise, Jr. | |
| 5,289,970 | A | 3/1994 | McClure | |
| 5,395,043 | A * | 3/1995 | Bacques et al. | 229/109 |
| 5,560,539 | A * | 10/1996 | Baxter | 229/109 |
| 5,752,648 | A * | 5/1998 | Quaintance | 229/109 |
| 5,979,746 | A | 11/1999 | McLeod et al. | |
| 6,302,323 | B1 * | 10/2001 | Southwell | 229/174 |
| 6,394,742 | B1 * | 5/2002 | Buscema | 229/918 |
| 6,481,619 | B1 | 11/2002 | Jackson | |
| 6,598,785 | B2 * | 7/2003 | Quaintance | 229/109 |
| 6,899,266 | B2 | 5/2005 | Conway | |
| 7,017,798 | B2 | 3/2006 | Pope et al. | |
| 7,484,655 | B2 * | 2/2009 | McLeod | 229/170 |
| 7,665,654 | B2 * | 2/2010 | McLeod | 229/170 |
| 7,850,064 | B2 * | 12/2010 | McLeod | 229/174 |
| 8,091,770 | B2 * | 1/2012 | McLeod | 229/170 |
| 2004/0149815 | A1 | 8/2004 | Holdsworth et al. | |
| 2005/0145687 | A1 * | 7/2005 | Conway | 229/174 |
| 2005/0236466 | A1 | 10/2005 | McLeod | |
| 2006/0213958 | A1 | 9/2006 | Valenzuela et al. | |
| 2006/0231603 | A1 | 10/2006 | McLeod | |

FOREIGN PATENT DOCUMENTS

| | | |
|---|---|---|
| FR | 2669301 | 11/1990 |
| GB | 2229426 | 9/1990 |

* cited by examiner

*Primary Examiner* — Gary Elkins
(74) *Attorney, Agent, or Firm* — Barnes & Thornburg LLP

(57) ABSTRACT

A container is adapted to transport food or other articles. The container includes a floor, two side walls, a front end closure coupled to the side walls, and a rear end closure coupled to the side walls.

28 Claims, 15 Drawing Sheets

FIG 15
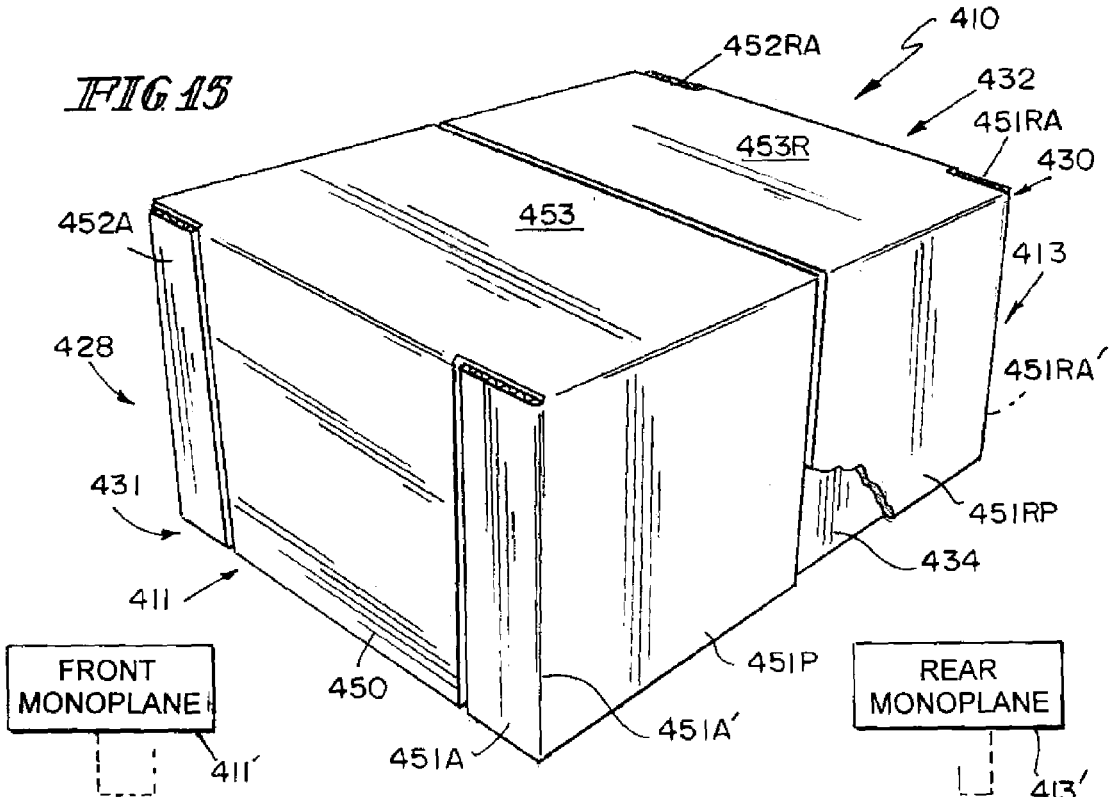
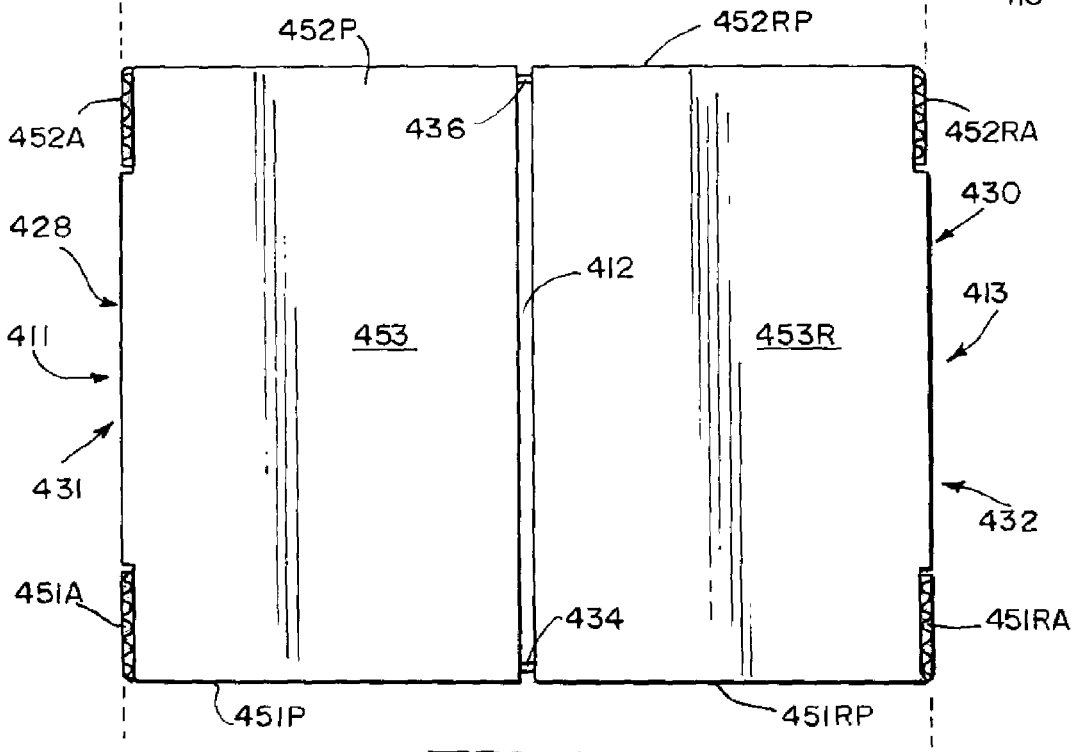
FIG 16

OCTAGON-SHAPED FOOD-TRANSPORT CONTAINER

CROSS-REFERENCE TO RELATED APPLICATIONS

This application is a divisional of U.S. application Ser. No. 12/326,045, filed Dec. 1, 2008 now U.S. Pat. No. 8,019,770, which claims priority under 35 U.S.C. §119(c) to U.S. Provisional Application Ser. No. 61/012,349, filed Dec. 7, 2007, which are expressly incorporated by reference herein.

BACKGROUND

The present disclosure relates to trays and containers, and particularly to trays and containers made of paperboard. More particularly, the present disclosure relates to a sturdy tray or container made of a corrugated material and configured to contain food or other items.

SUMMARY

An article-transport container or tray is adapted to transport food or other articles from one site to another. The container includes a floor, two side walls, a front end closure coupled to the floor and the side walls, and a rear end closure coupled to the floor and the side walls. These walls and closures cooperate to form an interior article-receiving region above the floor.

In illustrative embodiments, each of the front and rear end closures comprises a monoplanar multipart end panel. The front end closure includes a narrow-width front end wall coupled to a first end of the floor and sized to have a width that is narrower than the width of the first end of the floor. The front end closure also includes a front anchor strip coupled to the narrow-width front end wall and to each of the side walls in the container. Two auxiliary anchor flaps included in the front anchor strip are arranged to lie in spaced-apart relation to one another to locate the narrow-width front end wall therebetween and to cooperate with the narrow-width front end wall to define the monoplanar multipart end panel of the front end closure.

Additional features of the disclosure will become apparent to those skilled in the art upon consideration of the following detailed description of illustrative embodiments exemplifying the best mode of carrying out the disclosure as presently perceived.

BRIEF DESCRIPTION OF THE DRAWINGS

The detailed description particularly refers to the accompanying figures in which:

FIG. 9 shows a portion of a blank in accordance with a second embodiment of the present disclosure;

FIG. 10 is a view similar to FIG. 7 following folding movement of a first anxiliary canopy anchor flap into a flap-receiving channel provided in the front end of the container, with a portion of the front canopy broken away to show the mitered inside corner;

FIG. 11 is an enlarged sectional view taken along line 11-11 of FIG. 10 showing the 90° outside corner portion and the mitered inside corner portion;

FIG. 12 is a perspective view of a container with monoplanar multipart end panels in accordance with a third embodiment of the present disclosure;

FIG. 13 is a top plan view of the container of FIG. 12;

FIG. 14 is a plan view of a blank of corrugated material used to form the container of FIGS. 12 and 13;

FIG. 15-18 relate to a fully enclosed container characterized by a two-part lid, 90° outside corner portions, and 90° inside corner portions;

FIG. 15 is a perspective view of a container with monoplanar multipart end panels in accordance with a fourth embodiment of the present disclosure;

FIG. 16 is a top plan view of the container of FIG. 15;

FIG. 17 is a plan view of a blank of corrugated material used to form the container of FIGS. 15 and 16;

FIG. 18 is an enlarged perspective view of the container of FIGS. 15 and 16 showing folding movement of the rear end closure;

FIG. 19 is a perspective view of a container with monoplanar multipart end panels in accordance with a fifth embodiment of the present disclosure;

FIG. 20 is a top plan view of the container of FIG. 19;

FIG. 21 is a plan view of a blank of corrugated material used to form the container of FIGS. 19 and 20;

FIG. 22 is a perspective view of a container with multipart end panels in accordance with a sixth embodiment of the present disclosure;

FIG. 23 is a top plan view of the container of FIG. 22;

FIG. 24 is a plan view of a blank of corrugated material used to form the container of FIGS. 22 and 23; and FIG. 25 is an enlarged perspective view of the container of FIGS. 22 and 23 showing folding movement of the rear end closure.

DETAILED DESCRIPTION

Figure 1:
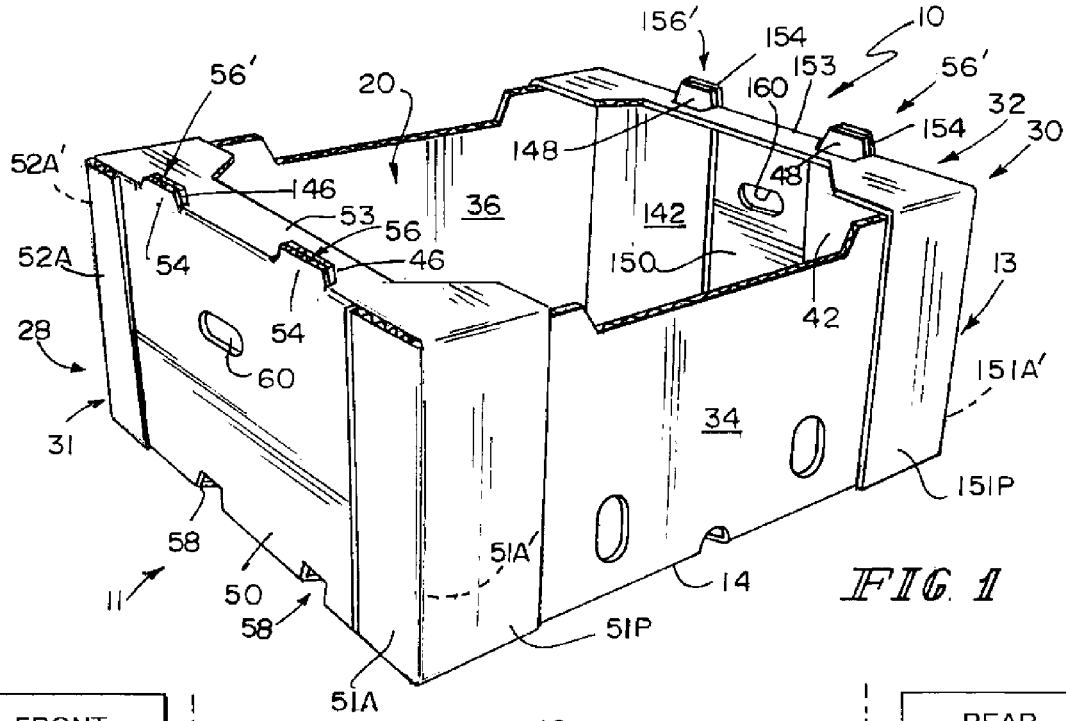
FIG. 1 is a perspective view of an erected food-transport container with monoplanar multipart end panels in accordance with a first embodiment of the present disclosure showing (on the left) a front end closure comprising a narrow-width front end wall coupled to a horizontal front canopy and located between two spaced-apart auxiliary canopy anchor flaps included in the front end closure and associated with the canopy and showing a horizontal rear canopy lying in spaced-apart relation to the horizontal front canopy and, in series, portions of a left side wall, a narrow-width rear end wall, and a right side wall, and showing that the two spaced-apart auxiliary canopy anchor flaps and the narrow-width front end wall located therebetween lie in the same plane and cooperate to define a monoplanar multipart end panel extending along the front canopy and having a generally planar exterior surface.
Figure 2:
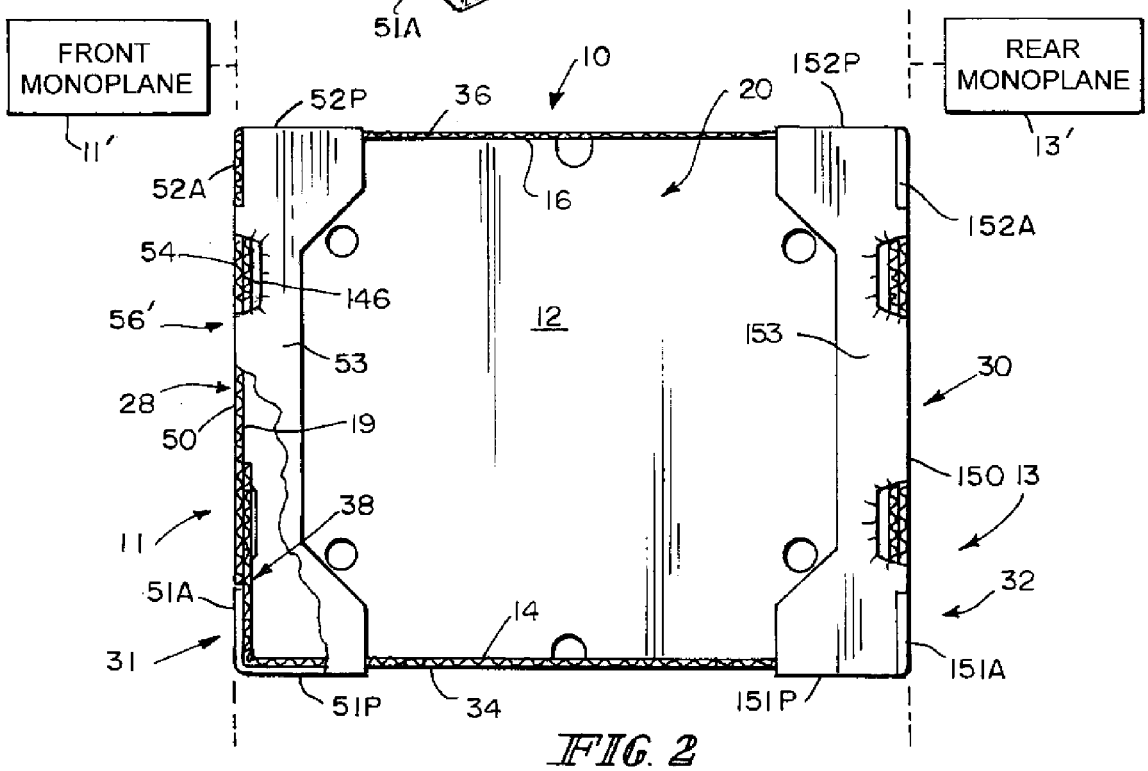
FIG. 2 is a top plan view of the food-transport container of FIG. 1 showing a front monoplanar multipart end panel included in the front end closure (on the left end of the container) and a rear monoplanar multipart end panel included in a rear end closure (on the right end of the container) wherein a portion of the front canopy is broken away to show a first auxiliary canopy anchor flap arranged to lie adjacent to the narrow-width front end wall to define a portion of the monoplanar multipart front end panel.

An article-transport container 10 is provided, as shown in FIGS. 1 and 2, for carrying various items. Container 10 is configured to include front and rear monoplanar multipart end panels 11 and 13 as suggested in FIG. 2. Each of end panels 11, 13 comprises multiple parts that cooperate to form an exterior surface that lies in a single plane (i.e., monoplane). As suggested in FIG. 2, the exterior surface of front end panel 11 lies in front monoplane 11'. The exterior surface of rear end panel 13 lies in rear monoplane 13' as suggested in FIG. 2. Other embodiments, in accordance with the present disclosure, of containers including monoplanar multipart end panels are shown, for example, in FIGS. 9-11, 12-14, 15-18, and 19-20. An octagon-shaped container including a multipart end panel in accordance with the present disclosure in suggested in FIGS. 22-25.

Container 10 is formed to include an interior region 20 for receiving various items such as fruits, vegetables, or any type of agricultural or meat product (not shown). Container 10 is well-suited to carry a wide variety of other items, articles, or products.

Figure 3:
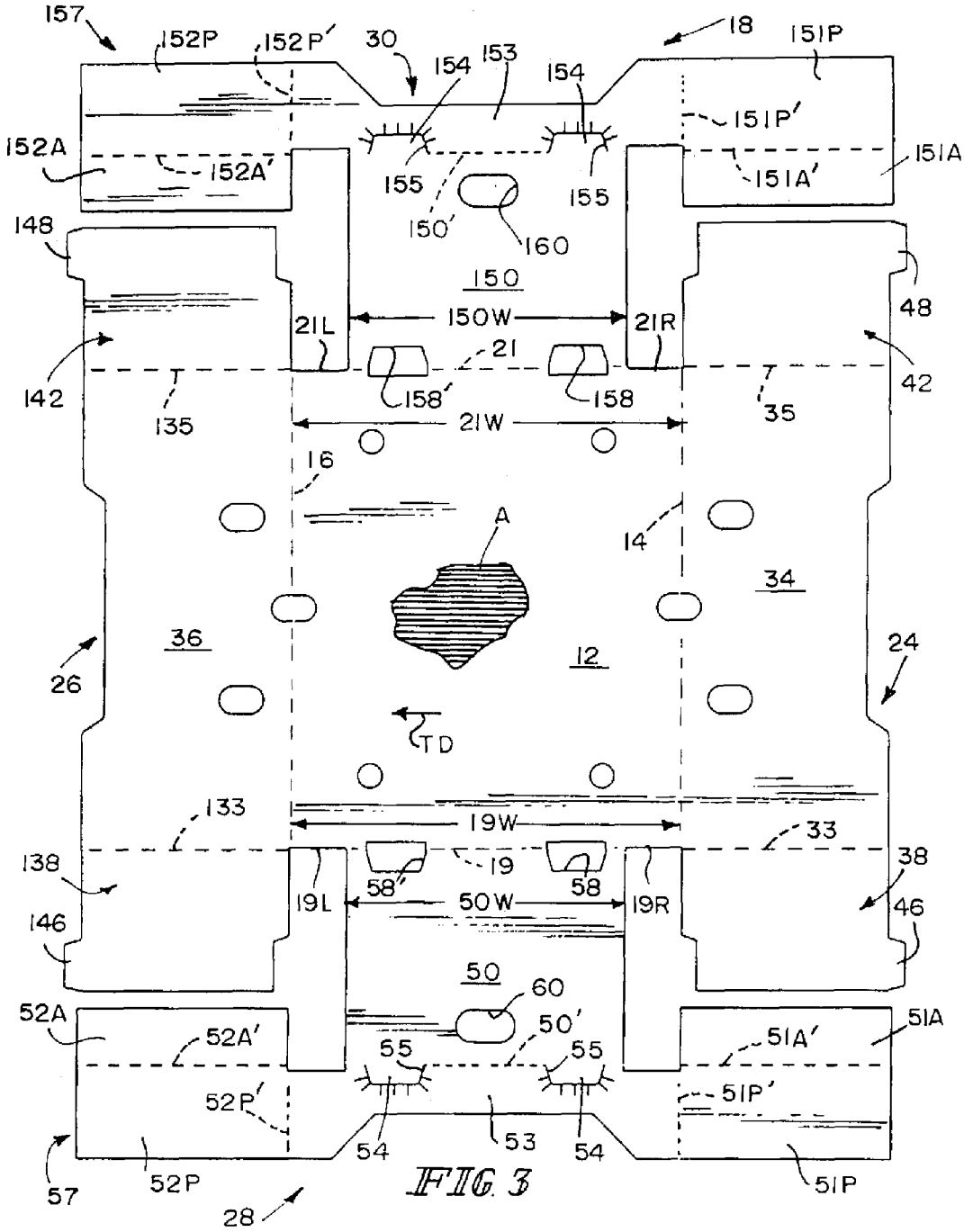
FIG. 3 is a plan view of a blank of corrugated material used to form the container of FIGS. 1 and 2 and showing that the unfolded front end closure (at the bottom of the page) includes a narrow-width front end wall coupled to a floor having a relatively wider front edge and a front anchor strip comprising, in series, from right to left, the first auxiliary canopy anchor flap, a first primary canopy anchor flap, the front canopy (coupled to the narrow-width front end wall), a second primary canopy anchor flap, and a second auxiliary canopy anchor flap and showing a similar unfolded rear end closure (at the top of the page)

Container 10 is made, for example, from a blank 18 of corrugated material, as shown in FIG. 3. Blank 18 includes floor 12, a right side strip 24 appended to floor 12 along side fold line 14, a left side strip 26 appended to floor 12 along side fold line 16, a front end closure 28 appended to floor 12 along end fold line 19, and a rear end closure 30 appended to floor 12 along end fold line 21. Right side strip 24, left side strip 26, front end closure 28, and rear end closure 30 cooperate to form a border coupled to floor 12 and arranged to cooperate with floor 12 to form interior region 20.

Figure 4:
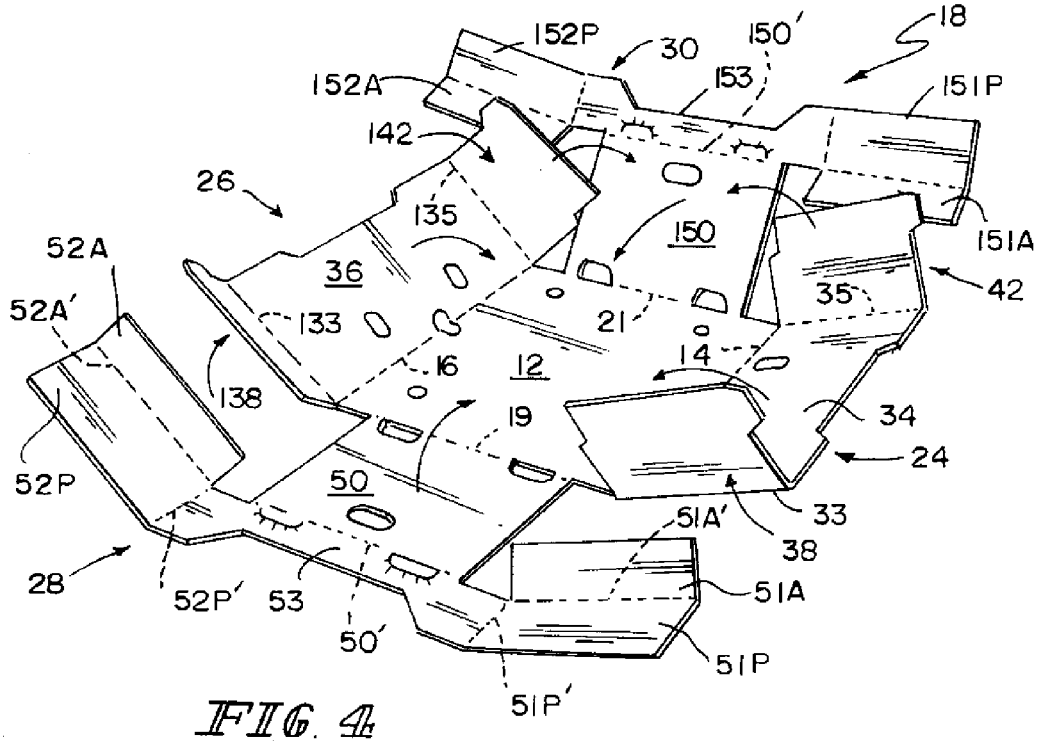
FIG. 4 is a perspective view of the blank of FIG. 3 being folded to erect the narrow-width rear end wall and the left and right side walls and showing folding movement of each of the four auxiliary canopy anchor flaps included in the front and rear end closures about a fold line relative to a companion primary canopy anchor flap.

Rear end closure 30 is configured to be folded as suggested in FIG. 4 to produce a rear end 32 of container 10 as suggested in FIGS. 1 and 2. Front end closure 28 is configured to be folded as suggested in FIG. 5 to produce a front end 31 of container 10 as suggested in FIGS. 1 and 2. It is within the scope of the present disclosure to make blank 18 from a variety of materials including corrugated paperboard, folding carton, and solid fiber and other materials such as plastic sheeting and plastic corrugated.

Right side strip 24 includes a right side wall 34, a first front end wall anchor flap 38, and a first rear end wall anchor flap 42 as shown in FIG. 3. Right side wall 34 is appended to floor 12 along side fold line 14. Right side strip 24 also includes a front right stacking tab portion 46 appended to an outer corner of first front end wall anchor flap 38 and a rear right stacking tab portion 48 appended to an outer corner of first rear end wall anchor flap 42 as shown in FIG. 3. First front end wall anchor flap 38 is coupled to right side wall 34 along a front flap fold line 33. First rear end wall anchor flap 42 is coupled to right side wall 34 along a rear flap fold line 35. Right side wall 34 is arranged to interconnect anchor flaps 38, 42 as suggested in FIG. 3.

Left side strip 26 includes a left side wall 36, a second front end wall anchor flap 138, and a second rear end wall anchor flap 142 as shown in FIG. 3. Left side wall 36 is appended to floor 12 along side fold line 16. Left side strip 26 also includes a front left stacking tab portion 146 appended to an outer corner of second front end wall anchor flap 138 and a rear left stacking tab portion 148 appended to an outer corner of second rear end wall anchor flap 142 as shown in FIG. 3. Second front end wall anchor flap 138 is coupled to left side wall 36 along a front flap fold line 133. Second rear end wall anchor flap 142 is coupled to left side wall 36 along a rear flap fold line 135. Left side wall 36 is arranged to interconnect anchor flaps 138, 142 as suggested in FIG. 3.

Front end closure 28 includes a narrow-width front end wall 50 coupled to one end of floor 12 along end fold line 19 and a front anchor strip 57 coupled to front end wall 50 along strip fold line 50 as suggested in FIGS. 3 and 4. Front anchor strip 57 provides means for anchoring front end wall 50 to each of right and left side walls 34, 36 to establish front end 31 of container 10.

Front end wall 50 has a width 50W that is less than the width 19W of floor 12 along end fold line 19 as suggested in FIG. 3. In the illustrated embodiment, narrow-width front end wall 50 is centered relative to floor 12 along end fold line 19 to produce front left edge 19L of floor 12 and front right edge 19R of floor 12. Front left edge 19L is about equal in length to front right edge 19R.

Figure 7:
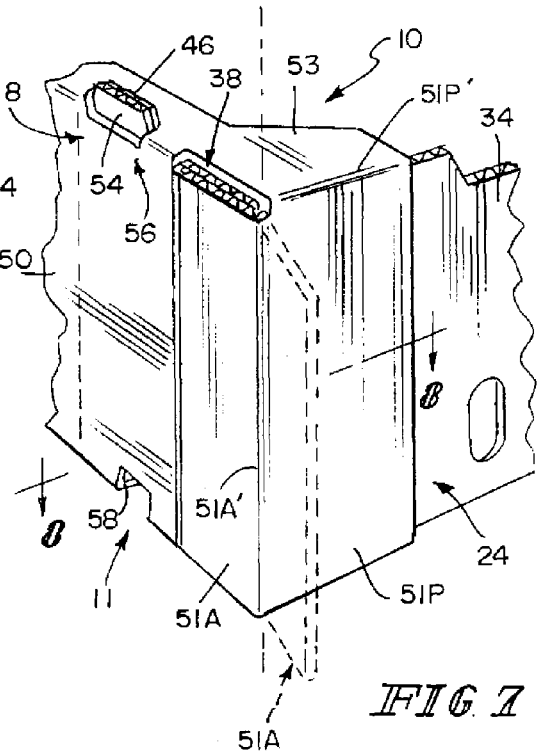
FIG. 7 is a view similar to FIG. 6 following folding movement of the first auxiliary canopy anchor flap into the flap-receiving channel to lie in generally edge-to-edge relation with the upright narrow-width front end wall.

Front anchor strip 57 includes a front canopy 53 coupled to front end wall 50 along strip fold line 50, a first primary canopy anchor flap 51P coupled to one end of front canopy 53 along primary flap fold line 51P, and a second primary canopy anchor flap 52P coupled to an opposite end of front canopy 53 along primary flap fold line 52P as suggested in FIG. 3. Front anchor strip 57 also includes a first auxiliary canopy anchor flap 51A coupled to first primary canopy anchor flap 51P along auxiliary flap fold line 51A' and a second auxiliary canopy anchor flap 52A coupled to second primary canopy anchor flap 52P along auxiliary flap fold line 52A' as suggested in FIG. 3. Primary and auxiliary flap fold lines 51A and 51P are arranged to lie in perpendicular relation to one another as suggested in FIGS. 3 and 7.

Rear end closure 30 includes a narrow-width rear end wall 150 coupled to an opposite end of floor 12 along end fold line 21 and a rear anchor strip 157 coupled to rear end wall 150 along strip fold line 150 as suggested in FIG. 3. Rear anchor strip 157 provides means for anchoring rear end wall 150 to each of right and left side walls 34, 36 to establish rear end 32 of container 10.

Rear end wall 150 has a width 150W that is less than the width 21W of floor 12 along end fold line 21 as suggested in FIG. 3. In the illustrated embodiment, rear end wall 150 is centered relative to floor 12 along end fold line 21 to produce rear left edge 21L of floor 12 and rear right edge 21R of floor 12. Rear left edge 21L is about equal in length to right rear edge 21R. Also, in the illustrated embodiment, width 19W is about equal to width 121W as suggested in FIG. 3 owing to the uniform width of floor 12.

Rear anchor strip 157 includes a rear canopy 153 coupled to end wall 150 along strip fold line 150, a first primary canopy anchor flap 151P coupled to one end of rear canopy 153 along primary flap fold line 151P, and a second primary canopy anchor flap 152P coupled to an opposite end of rear canopy 153 along primary flap fold line 152P' as suggested in FIG. 3. Rear anchor strip 157 also includes a first auxiliary canopy anchor flap 151A coupled to first primary canopy anchor flap 151P along auxiliary flap fold line 151A' and a second auxiliary canopy anchor flap 152A coupled to second primary canopy anchor flap 152P along auxiliary flap fold line 152A' as suggested in FIG. 3.

In an illustrative embodiment, the corrugation of blank 18 is positioned to run in a transverse direction TD as shown in insert A in FIG. 3. It is within the scope of the present disclosure to establish each of the fold lines disclosed herein by using score lines, creases, perforations, or perforations and score lines or by using another suitable technique.

As shown in FIG. 3, front end closure 28 also includes two spaced-apart trapezoid-shaped front stacking tabs 54 appended to front end wall 50. Front end closure 28 is formed to include a pair of slits 55 and one of slits 55 separates front canopy 53 from each front stacking tab 54 when blank 18 is in an unfolded state as shown in FIG. 3. Stacking tabs 54 are arranged to lie alongside front right and left stacking tabs 46, 146 when container 10 is erected as suggested in FIG. 1. Tab 46 and one of tabs 54 cooperate to form a first alignment tab 56 that is sized to fit into a portion of tab receiver 58 formed in an overlying companion container (not shown). Tab receiver 58 is formed in blank 18 along end fold line 19 as shown in FIG. 3. Tab 146 and the other of tabs 54 cooperate to form a second alignment tab 56 that is sized to fit into a portion of a tab receiver 58 formed in an overlying companion container (not shown). Tab receiver 58 is formed in blank 18 along end fold line 19 as shown in FIG. 3.

As shown in FIG. 3, front end wall 50 is formed to include a finger-receiving slot 60. As also shown in FIG. 3, rear end wall 150 is formed to include a finger-receiving slot 160.

As also shown in FIG. 3, rear end closure 30 also includes two trapezoid-shaped rear stacking tabs 154 appended to rear end wall 150. Rear end closure 30 is formed to include a pair of slits 155 and one of slits 55 separates rear canopy 153 from each rear stacking tab 154 when blank 18 is in an unfolded state as shown in FIG. 3. Stacking tabs 154 are arranged to lie alongside rear right and left stacking tabs 48, 148 when container 10 is erected as suggested in FIG. 1 Tab 48 and one of tabs 154 cooperate to form a first alignment tab 156 that is sized to fit into a portion of a tab receiver 158 formed in an overlying companion container (not shown). Tab receiver 158 is formed in blank 18 along end fold line 21 as shown in FIG. 3. Tab 148 and the other of tabs 154 cooperate to form a second alignment tab 156 that is sized to fit into a portion of a tab receiver 158 formed in an overlying companion container (not shown). Tab receiver 158 is formed in blank 18 along end fold line 21 as shown in FIG. 3.

Figure 5:
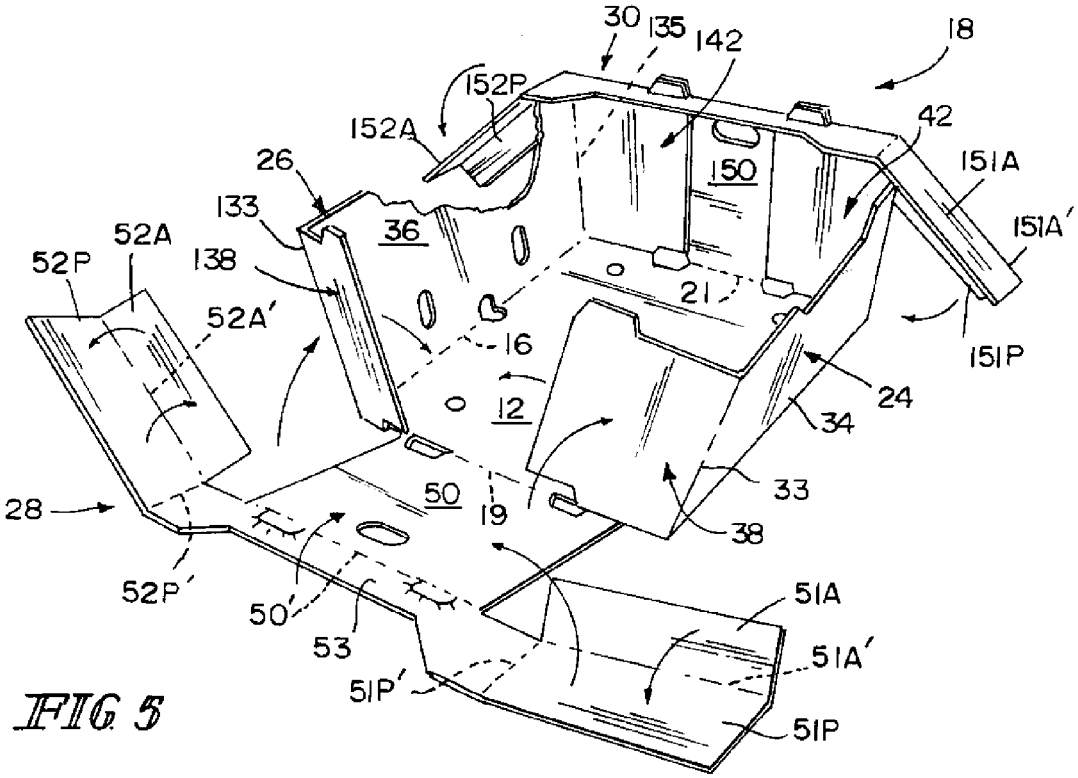
FIG. 5 is a view similar to FIG. 4, with a portion of the left side wall broken away, showing further folding of the companion first auxiliary and primary canopy anchor flaps in the rear end closure in a generally counterclockwise direction and further folding of the companion second auxiliary and primary canopy anchor flaps in the rear end closure in a generally clockwise direction.
Figure 6:
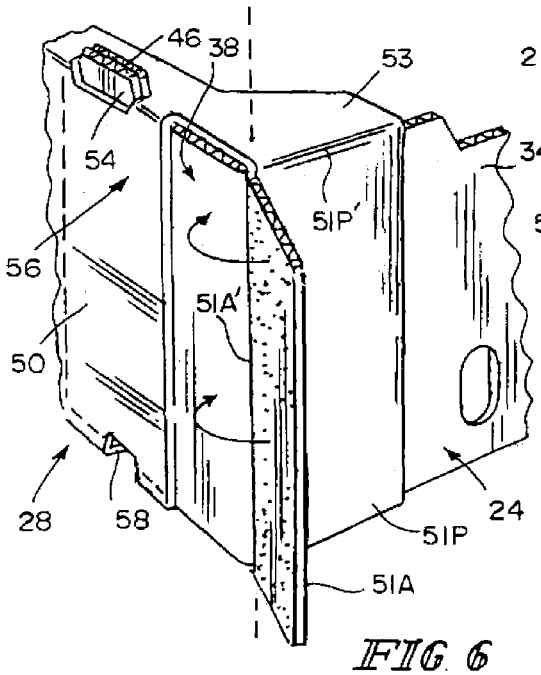
FIG. 6 is an enlarged partial view of a front right corner of the tray of FIG. 1 after the first primary canopy anchor flap has been mated with the right side wall but before final folding movement of the first auxiliary canopy anchor flap about a vertical axis along a fold line provided between the first auxiliary and primary canopy anchor flaps into a flap-receiving channel located next to a vertically extending first edge of the upright narrow-width front end wall.

Blank 18 is folded as shown, for example, in FIGS. 4 and 5 to produce the container 10 shown in FIG. 1. Once blank 18 is folded, primary canopy anchor flaps 51P, 52P, 151P, and 152P are used to retain container 10 in an erected condition as suggested in FIG. 1. First primary canopy anchor flap 51P is mated, e.g., adhered (using any suitable means), to right side wall 34 and second primary canopy anchor flap 52P is mated, e.g., adhered (using any suitable means), to left side wall 36 to form front end closure 28. Likewise, first primary canopy anchor flap 151P is mated, e.g., adhered (using any suitable means), to right side wall 34 and second primary canopy anchor flap 152P is mated, e.g., adhered (using any suitable means), to left side wall 36 to form rear end closure 30.

Figure 8:
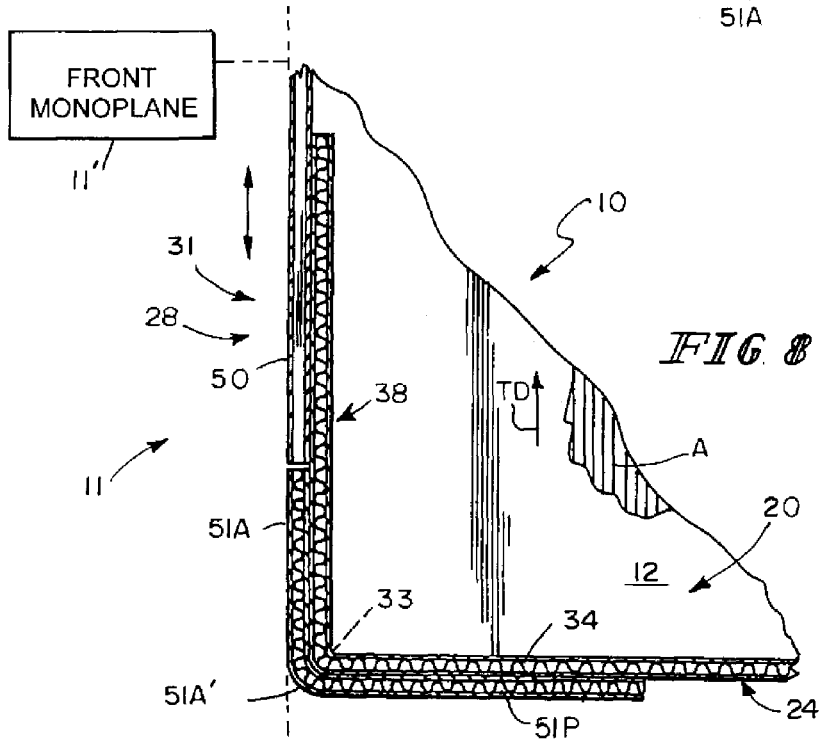
FIG. 8 is an enlarged sectional view taken along line 8-8 of FIG. 7 showing that the exterior surfaces of the narrow-width front end panel and the first auxiliary canopy anchor flap lie in generally the same plane (shown in phantom) to define a portion of the monoplanar multipart end panel in the front end closure and showing that the container is characterized by a 90° outside corner portion and a 90° inside corner portion.

As suggested in FIGS. 3 and 8, first primary canopy anchor flap 51P is coupled to right side wall 34, first auxiliary canopy anchor flap 51A is oriented to lie in perpendicular relation to first primary canopy anchor flap 51P to define a right-angled exterior corner portion of the first corner of the border, and first front end wall anchor flap 38 is oriented to lie in perpendicular relation to right side wall 34 to define a right-angled interior corner portion of the first corner of the border. The first side 14 of the floor is longer than the first end 19W of floor 12 as suggested in FIG. 3.

Figure 9:
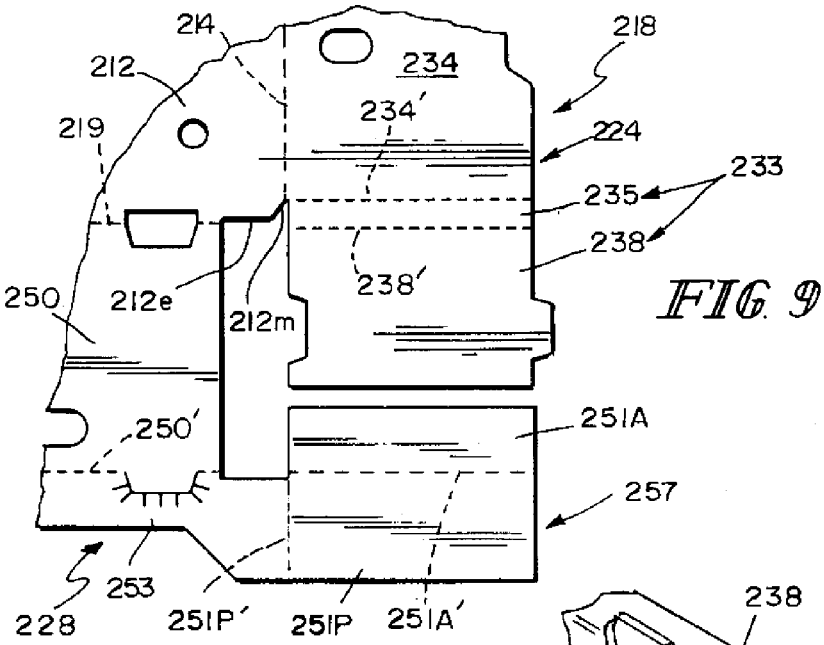
FIGS. 9-11 show how the blank of FIG. 3 can be varied to produce a container characterized by a 90° outside corner portion and a mitered inside corner portion.
Figure 10:
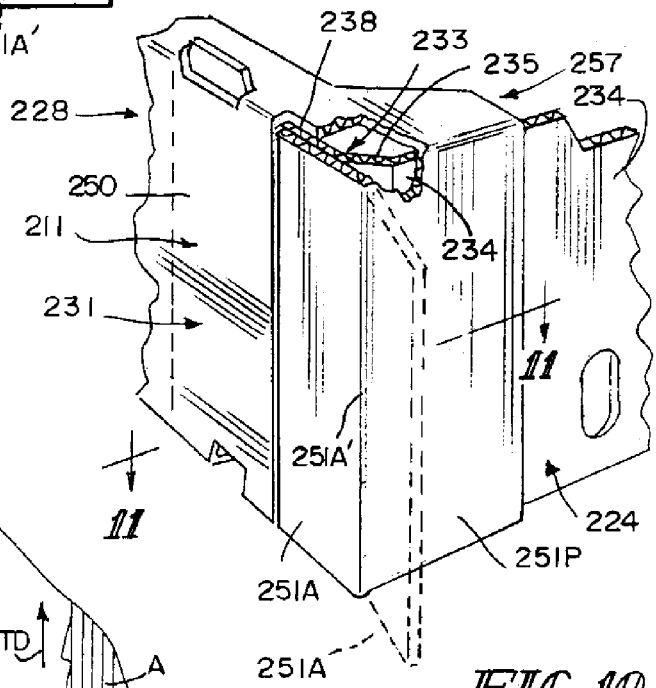
Figure 11:
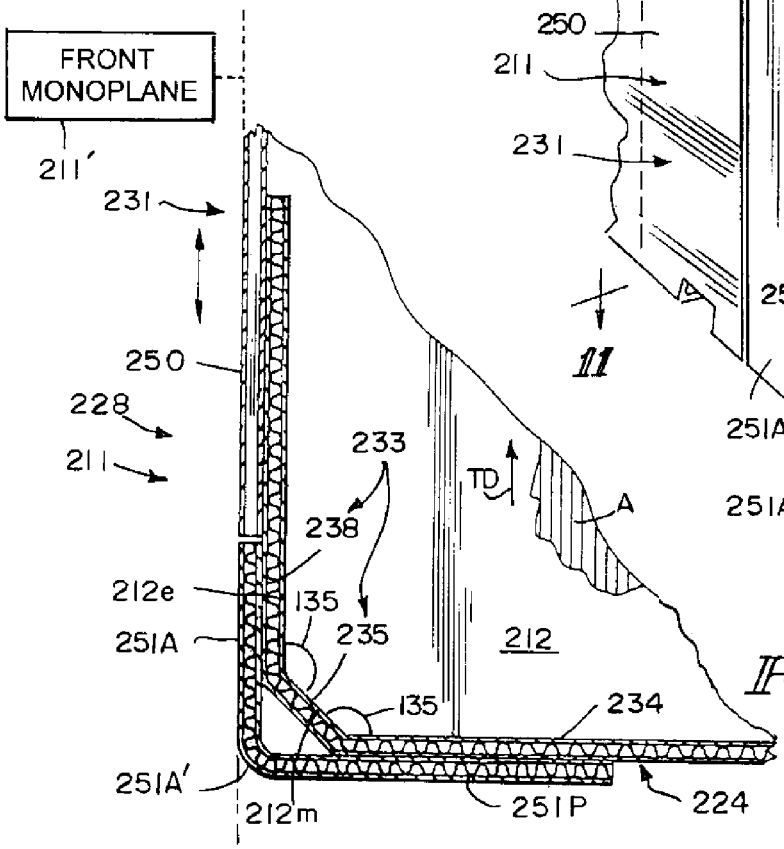

A portion of a blank 218 of corrugated material in accordance with a second embodiment of the present disclosure is shown in FIG. 9 and can be assembled as suggested in FIG. 10 to produce a corner of a container 210 as shown in FIG. 11. It should be noted that container 210 has a 90° right-angled outside corner portion and a mitered inside corner portion. In most respects, blank 218 is similar to blank 18 of FIG. 3.

Blank 218 includes floor 212, a right side strip 224 appended to floor 212 along side fold line 214, and a front end closure 228 appended to floor 212 along end fold line 219. Front end closure 228 is configured to be folded in a manner similar to that shown in FIG. 5 to produce a front end 231 of container 210 as suggested in FIGS. 10 and 11.

Right side strip 224 includes a right side wall 234 and a first front end wall anchor flap 233 comprising a tab 238 and a front right corner bridge 235 interconnecting right side wall 234 and tab 238 as suggested in FIG. 9. Front right corner bridge 235 is coupled to right side wall 234 along front flap fold line 234 and to tab 238 along tab fold line 238. Fold lines 234 and 238 are arranged to lie in spaced-apart parallel relation to one another in an illustrative embodiment as suggested in FIG. 9. Front right corner bridge 235 has a rectangular shape in the illustrated embodiment. A similar corner bridge (not shown) is also provided at the front left, rear left, and rear right portions of blank 218 in accordance with the present disclosure. Right side wall 234 is coupled to floor 212 along side fold line 214 as suggested in FIG. 9.

Front end closure 228 includes narrow-width front end wall 250 coupled to one end of floor 212 along end fold line 219 and a front anchor strip 257 coupled to front end wall 250 along a strip fold line 250 as suggested in FIGS. 9 and 10.

Front anchor strip 257 provides means for anchoring front end wall 250 to right side wall 234 to establish front end 231 of container 210. Front anchor strip 257 includes front canopy 253 coupled to front end wall 250 along strip fold line 250, a first primary canopy anchor flap 251P coupled to one end of front canopy 253 along primary flap fold line 251P, and a first auxiliary canopy anchor flap 251A coupled to first primary canopy anchor flap 251P along auxiliary flap fold line 251A.

As suggested in FIG. 9, floor 212 includes an end edge 212*e* and a mitered edge 212*m* arranged to interconnect end edge 212*e* and side fold line 214. End edge 212*e* is arranged to interconnect end fold line 219 and mitered edge 212*m* as also suggested in FIG. 9. Mitered edge 212*m* and each of end edge 212*e* and side fold line 214 cooperate to define obtuse included angles 135 of about 135° therebetween as shown in FIGS. 9 and 11. When folded, front right corner bridge 235 is arranged to confront (e.g., abut or lie alongside) mitered edge 212*m* to establish a mitered inside corner portion and tab 238 of first front end wall anchor flap 233 is arranged to confront (e.g., abut or lie alongside) end edge 212*e* as suggested in FIG. 11. When folded, as suggested in FIG. 11, container 210 includes a front monoplanar multi-part end panel 211 having an exterior surface that lies in a single plane (i.e., front monoplane 211).

As suggested in FIGS. 9-11, first primary canopy anchor flap 251P is coupled to right side wall 234, first auxiliary canopy anchor flap 251A is oriented to lie in perpendicular relation to first primary canopy anchor flap 251P to define a right-angled exterior corner portion of the first corner of the border, and first front end wall anchor flap 233 includes a tab 238 and a front right corner bridge 235 interconnecting right side wall 234 and tab 238. Tab 238 of first front end wall anchor flap 233 mates with first auxiliary canopy anchor flap 251A. Front right corner bridge 235 is oriented to cooperate with each of tab 238 and right side wall 234 to define an obtuse included angle 135 therebetween to define a mitered interior corner portion of the first corner of the border. Floor 212 further includes a mitered edge 212*m* interconnecting first end 218 of floor 212 and first side 214 of floor 212. Mitered edge 212*m* is oriented to cooperate with each of first end 219 and first side 214 to define an obtuse included angle therebetween. Front right corner bridge 235 is arranged to confront the mitered edge 212*m* as suggested in FIG. 11.

Figure 12:
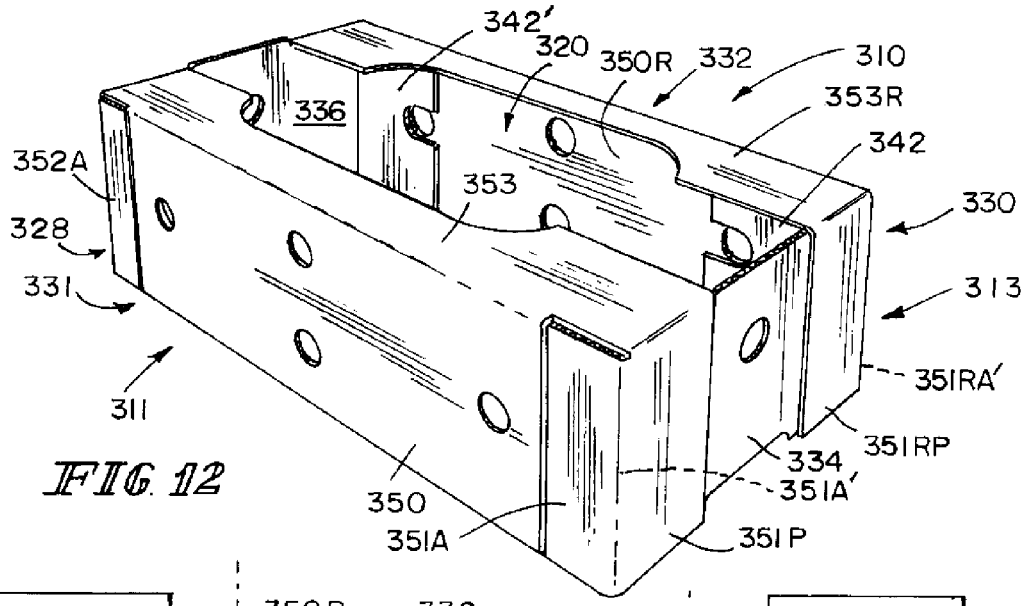
FIGS. 12-14 relate to a container characterized by 90° outside corner portions and 90° inside corner portions wherein the width of each of the front and rear end closures is greater than the length of the left and right side walls.
Figure 13:
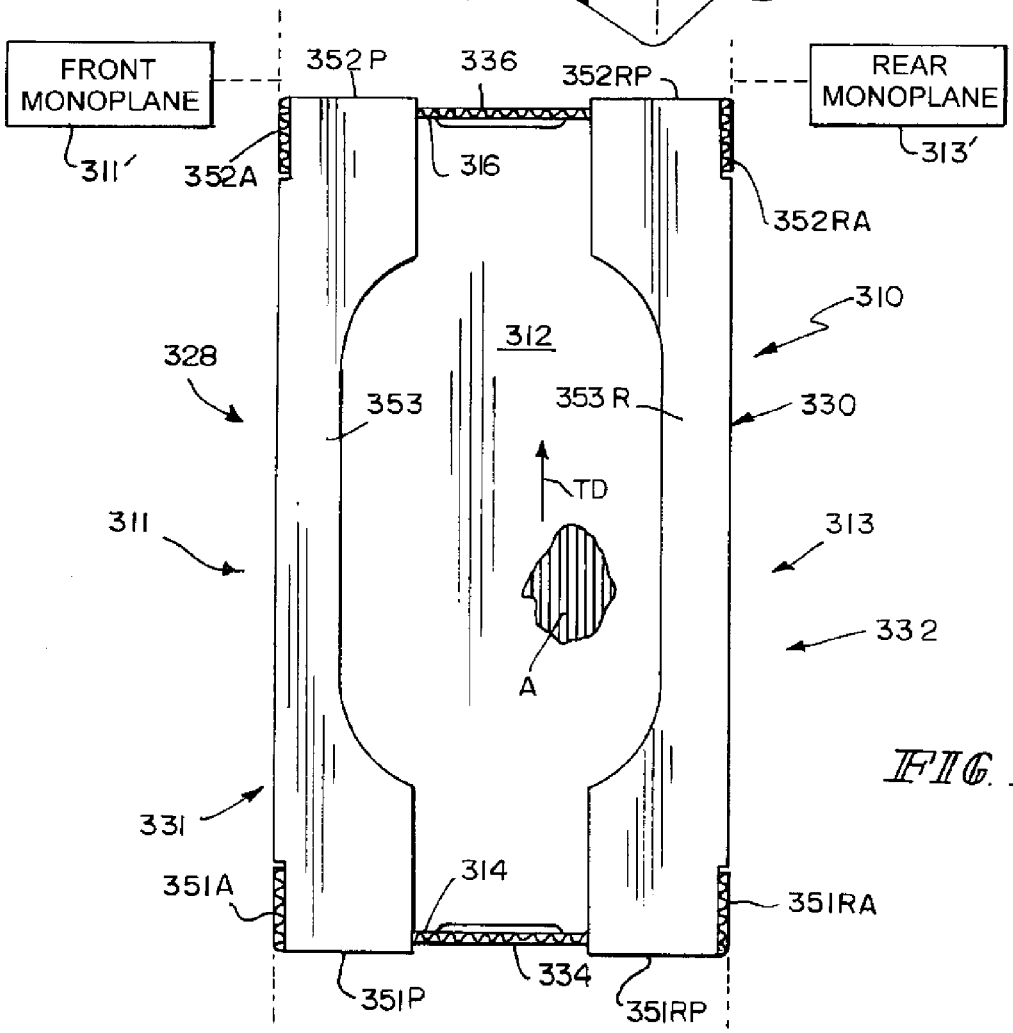
Figure 14:
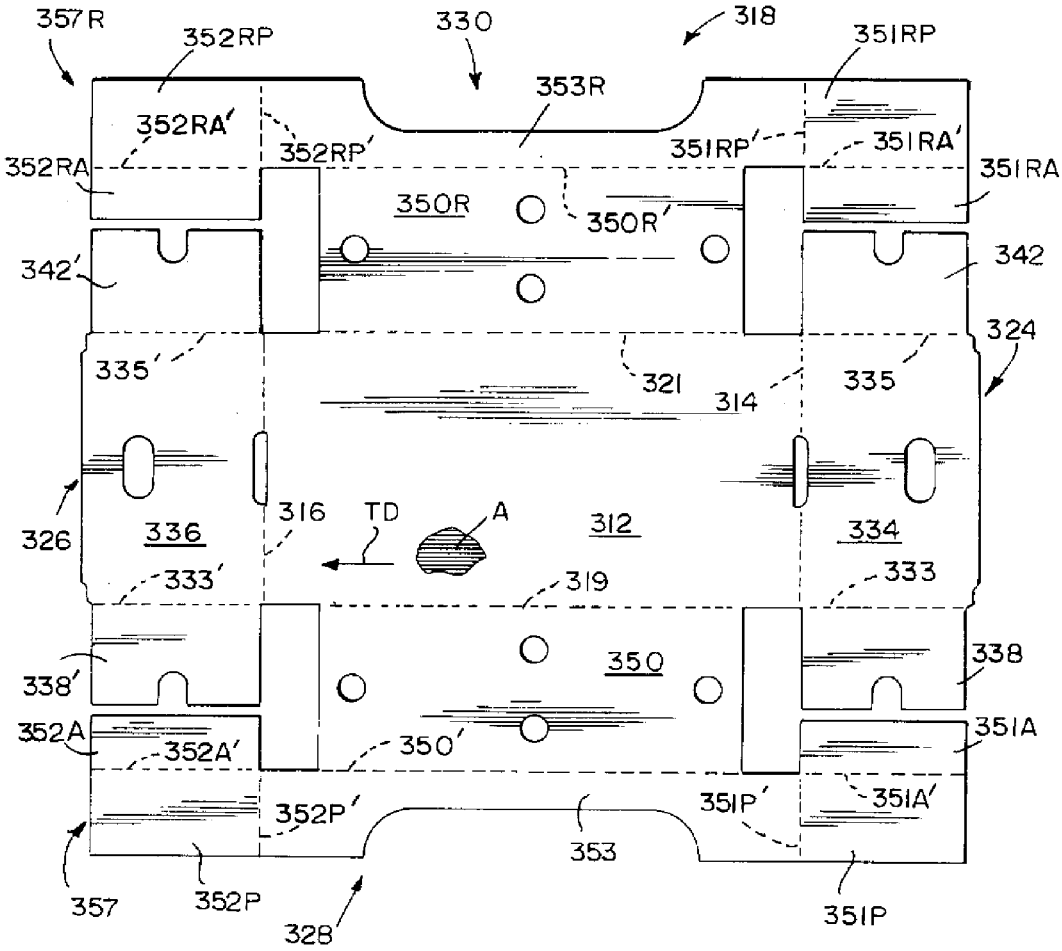

An article-transport container 310 in accordance with a third embodiment of the present disclosure is provided, as shown in FIGS. 12 and 13, for carrying various items and made using a blank 318 shown in FIG. 14. Container 310 is configured to include front and rear monoplanar multipart end panels 311 and 313 as suggested in FIG. 13. Each of end panels 311, 313 comprises multiple parts that cooperate to form an exterior surface that lies in a single plane (i.e., monoplane). As suggested in FIG. 13, the exterior surface of front end panel 311 lies in front monoplane 311. The exterior surface of rear end panel 313 lies in rear monoplane 313 as suggested in FIG. 13.

Container 310 is formed to include an interior region 320 for receiving various items such as fruits, vegetables, or any type of agricultural or meat product (not shown). Container 310 is well-suited to carry a wide variety of other items, articles, or products.

Container 310 is made, for example, from a blank 318 of corrugated material, as shown in FIG. 14. Blank 318 includes floor 312, a right side strip 324 appended to floor 312 along side fold line 314, a left side strip 326 appended to floor 312 along side fold line 316, a front end closure 328 appended to floor 312 along end fold line 319, and a rear end closure 330 appended to floor 312 along end fold line 321. Rear end closure 330 is configured to be folded to produce a rear end 332 of container 310 as suggested in FIGS. 12 and 13. Front end closure 328 is configured to be folded to produce a front end 331 of container 310 as suggested in FIGS. 12 and 13. It is within the scope of the present disclosure to make blank 318 from a variety of materials including corrugated paperboard, folding carton, and solid fiber and other materials such as plastic sheeting and plastic corrugated.

Right side strip 324 includes a right side wall 334, a first front end wall anchor flap 338, and a first rear end wall anchor flap 342 as shown in FIG. 14. Right side wall 334 is appended to floor 312 along side fold line 314. First front end wall anchor flap 338 is coupled to right side wall 334 along a front flap fold line 333. First rear end wall anchor flap 342 is coupled to right side wall 334 along a rear flap fold line 335. Right side wall 334 is arranged to interconnect anchor flaps 338, 342 as suggested in FIG. 14.

Left side strip 326 includes a left side wall 336, a second front end wall anchor flap 338, and a second rear end wall anchor flap 342 as shown in FIG. 14. Left side wall 336 is appended to floor 312 along side fold line 316. Second front end wall anchor flap 338 is coupled to left side wall 336 along a front flap fold line 333. Second rear end wall anchor flap 342 is coupled to left side wall 336 along a rear flap fold line 335. Left side wall 336 is arranged to interconnect anchor flaps 338, 342 as suggested in FIG. 14.

Front end closure 328 includes a narrow-width front end wall 350 coupled to one end of floor 312 along end fold line 319 and a front anchor strip 357 coupled to front end wall 350 along strip fold line 350 as suggested in FIG. 14. Front anchor strip 357 provided means for anchoring front end wall 350 to each of right and left side walls 334, 336 to establish front end 331 of container 310 as suggested in FIGS. 12 and 13.

Front anchor strip 357 includes a front canopy 353 coupled to front end wall 350 along strip fold line 350, a first primary canopy anchor flap 351P coupled to one end of front canopy 353 along primary flap fold line 351P, and a second primary canopy anchor flap 352P coupled to an opposite end of front canopy 353 along primary flap fold line 352P as suggested in FIG. 14. Front anchor strip 357 also includes a first auxiliary canopy anchor flap 351A coupled to first primary canopy anchor flap 351P along auxiliary flap fold line 351A and a second auxiliary canopy anchor flap 352A coupled to second primary canopy anchor flap 352P along auxiliary flap fold line 352A as suggested in FIG. 14.

Rear end closure 330 includes a narrow-width rear end wall 350R coupled to an opposite end of floor 312 along end fold line 321 and a rear anchor strip 357R coupled to rear end wall 350R along strip fold line 350R as suggested in FIG. 14. Rear anchor strip 357R provides means for anchoring rear end wall 350R to each of right and left side walls 334, 336 to establish rear end 332 of container 310 as suggested in FIGS. 12 and 13.

Rear anchor strip 357R includes a rear canopy 353R coupled to end wall 350R along strip fold line 350R, a first primary canopy anchor flap 351RP coupled to one end of rear canopy 353R along primary flap fold line 351RP, and a second primary canopy anchor flap 352RP coupled to an opposite end of rear canopy 353R along primary flap fold line 352RP as suggested in FIG. 14. Rear anchor strip 357R also includes a first auxiliary canopy anchor flap 351RA coupled to first primary canopy anchor flap 351RP along auxiliary flap fold line 351RA and a second auxiliary canopy anchor flap 352RA coupled to second primary canopy anchor flap 352RP along auxiliary flap fold line 352RA as suggested in FIG. 14.

In an illustrative embodiment, the corrugation of blank 318 is positioned to run in a transverse direction TD as shown in insert A in FIG. 14. It is within the scope of the present disclosure to establish each of the fold lines disclosed herein by using score lines, creases, perforations, or perforations and score lines or by using another suitable technique.

Blank 318 is folded in a manner similar to that shown in FIGS. 4 and 5 to produce the container 310 shown in FIG. 12. Once blank 318 is folded, primary canopy anchor flaps 351P, 352P, 351RP, and 352RP are used to retain container 310 in an erected condition as suggested in FIG. 12. First primary canopy anchor flap 351P is mated, e.g., adhered (using any suitable means), to right side wall 334 and second primary canopy anchor flap 352P is mated, e.g., adhered (using any suitable means), to left side wall 336 to form front end closure 328. Likewise, first primary canopy anchor flap 351RP is mated, e.g., adhered (using any suitable means), to right side wall 334 and second primary canopy anchor flap 352RP is mated, e.g., adhered (using any suitable means), to left side wall 336 to form rear end closure 330.

As suggested in FIGS. 12-14, first primary canopy anchor flap 351P is coupled to right side wall 334, first auxiliary canopy anchor flap 351A is oriented to lie in perpendicular relation to first primary canopy anchor flap 351P to define a right-angled exterior corner portion of the first corner of the border, and first front end wall anchor flap 338 is oriented to lie in perpendicular relation to right side wall 334 to define a right-angled interior corner portion of the first corner of the border. The first side 319 of the floor is longer than the first end 314 of floor 312 as suggested in FIG. 14.

Figure 17:
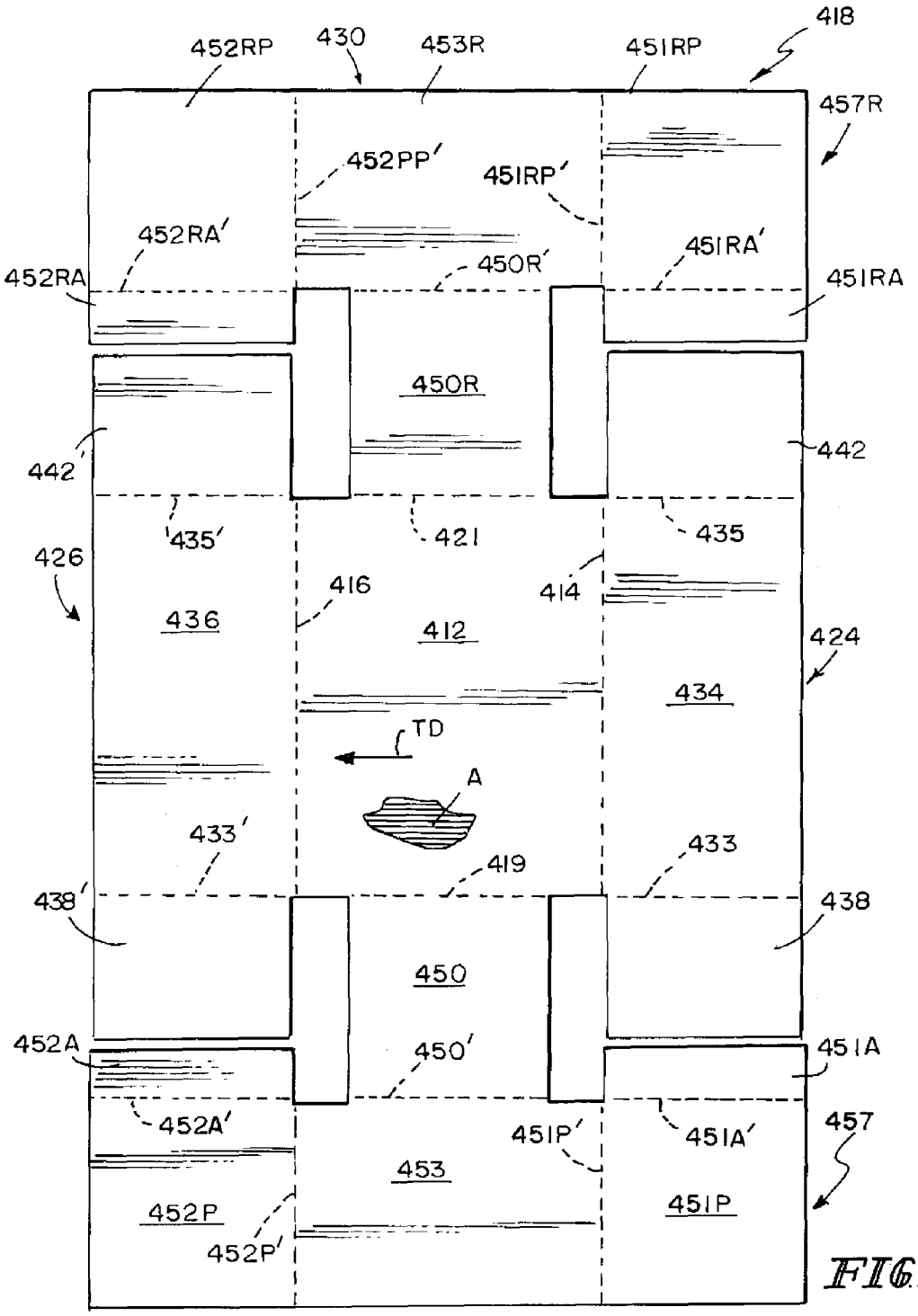

An article-transport container 410 in accordance with a fourth embodiment of the present disclosure is provided, as shown in FIGS. 15 and 16, for carrying various items and made using a blank 418 shown in FIG. 17. Container 410 is configured to include front and rear monoplanar multipart end panels 411 and 413 as suggested in FIG. 16. Each of end panels 411, 413 comprises multiple parts that cooperate to form an exterior surface that lies in a single plane (i.e., monoplane). As suggested in FIG. 16, the exterior surface of front end panel 411 lies in front monoplane 411. The exterior surface of rear end panel 413 lies in rear monoplane 413 as suggested in FIG. 16.

Figure 18:
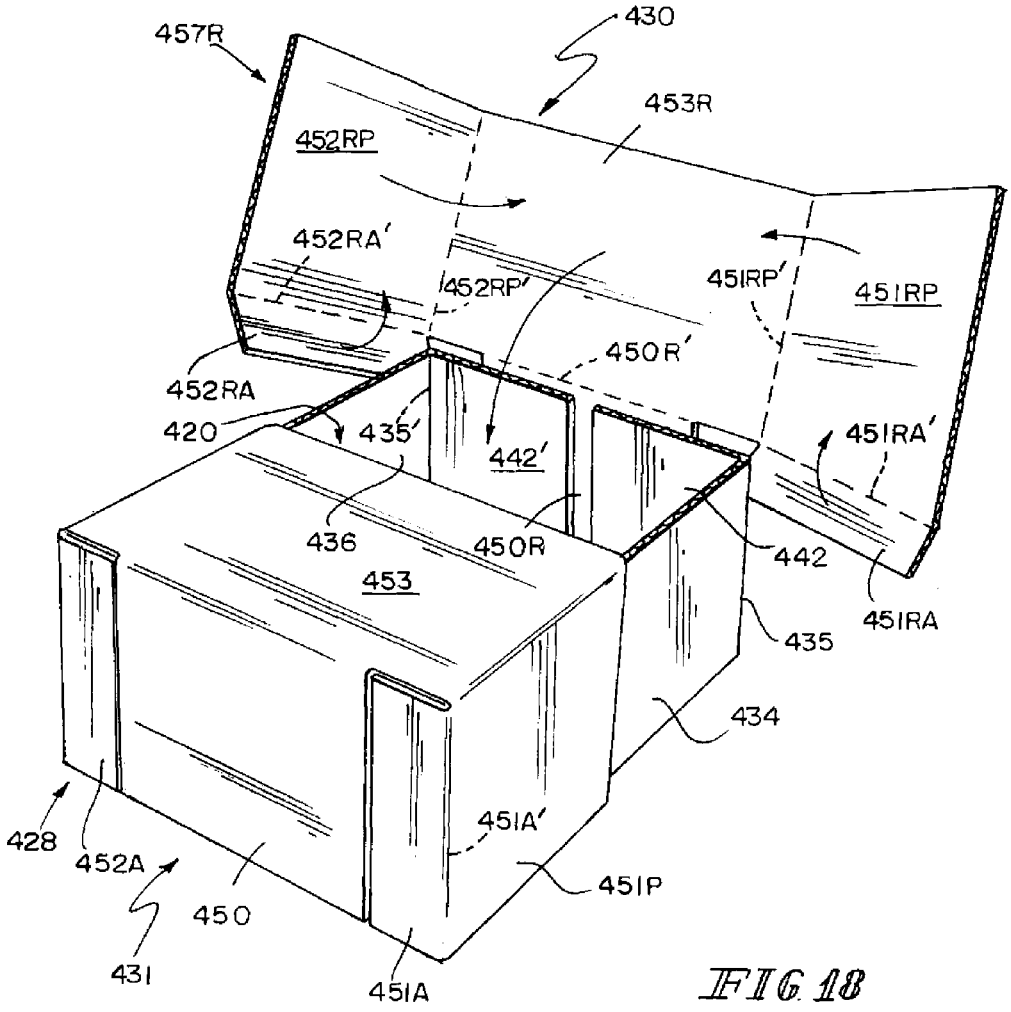

Container 410 is formed to include an interior region 420 as suggested in FIG. 18 for receiving various items such as fruits, vegetables, or any type of agricultural or meat product (not shown). Container 410 is well-suited to carry a wide variety of other items, articles, or products.

Container 410 is made, for example, from a blank 418 of corrugated material, as shown in FIG. 17. Blank 418 includes floor 412, a right side strip 424 appended to floor 412 along side fold line 414, a left side strip 426 appended to floor 412 along side fold line 416, a front end closure 428 appended to floor 412 along end fold line 419, and a rear end closure 430 appended to floor 412 along end fold line 421. Rear end closure 430 is configured to be folded to produce a rear end 432 of container 410 as suggested in FIGS. 15 and 16. Front end closure 428 is configured to be folded to produce a front end 431 of container 410 as suggested in FIGS. 15 and 16. It is within the scope of the present disclosure to make blank 418 from a variety of materials including corrugated paperboard, folding carton, and solid fiber and other materials such as plastic sheeting and plastic corrugated.

Right side strip 424 includes a right side wall 434, a first front end wall anchor flap 438, and a first rear end wall anchor flap 442 as shown in FIG. 17. Right side wall 434 is appended to floor 412 along side fold line 414. First front end wall anchor flap 438 is coupled to right side wall 434 along a front flap fold line 433. First rear end wall anchor flap 442 is coupled to right side wall 434 along a rear flap fold line 435. Right side wall 434 is arranged to interconnect anchor flaps 438, 442 as suggested in FIG. 17.

Left side strip 426 includes a left side wall 436, a second front end wall anchor flap 438, and a second rear end wall anchor flap 442 as shown in FIG. 17. Left side wall 436 is appended to floor 412 along side fold line 416. Second front end wall anchor flap 438 is coupled to left side wall 436 along a front flap fold line 433. Second rear end wall anchor flap 442 is coupled to left side wall 436 along a rear flap fold line 435. Left side wall 436 is arranged to interconnect anchor flaps 438, 442 as suggested in FIG. 17.

Front end closure 428 includes a narrow-width front end wall 450 coupled to one end of floor 412 along fold line 419 and a front anchor strip 457 coupled to front end wall 450 along strip fold line 450 as suggested in FIG. 17. Front anchor strip 457 provided means for anchoring front end wall 450 to each of right and left side walls 434, 436 to establish front end 431 of container 410 as suggested in FIGS. 15 and 16.

Front anchor strip 457 includes a front canopy 453 coupled to front end wall 450 along strip fold line 450, a first primary canopy anchor flap 451P coupled to one end of front canopy 453 along primary flap fold line 451P, and a second primary canopy anchor flap 452P coupled to an opposite end of front canopy 453 along primary flap fold line 452P as suggested in FIG. 17. Front anchor strip 457 also includes a first auxiliary canopy anchor flap 451A coupled to first primary canopy anchor flap 451P along auxiliary flap fold line 451A and a second auxiliary canopy anchor flap 452A coupled to second primary canopy anchor flap 452P along auxiliary flap fold line 452A as suggested in FIG. 17.

Rear end closure 430 includes a narrow-width rear end wall 450R coupled to an opposite end of floor 412 along fold line 421 and a rear anchor strip 457R coupled to rear end wall 450R along fold line 450R as suggested in FIG. 17. Rear anchor strip 457R provides means for anchoring rear end wall 450R to each of right and left side walls 434, 436 to establish rear end 432 of container 410 as suggested in FIGS. 15 and 16.

Rear anchor strip 457R includes a rear canopy 453R coupled to end wall 450R along strip fold line 450R, a first primary canopy anchor flap 451 RP coupled to one end of rear canopy 453R along primary flap fold line 451RP, and a second primary canopy anchor flap 452RP coupled to an opposite end of rear canopy 453R along primary flap fold line 452RP as suggested in FIG. 17. Rear anchor strip 457R also includes a first auxiliary canopy anchor flap 451RA coupled to first primary canopy anchor flap 451 RP along auxiliary flap fold line 451RA and a second auxiliary canopy anchor flap 452RA coupled to second primary canopy anchor flap 452RP along auxiliary flap fold line 452RA as suggested in FIG. 17.

Front and rear canopies 453, 453R cooperate to form a two-piece lid covering an opening into interior region 420 of container 410 as shown, for example, in FIG. 15. Movement of rear canopy 453 to assume a closed position is shown, for example, in FIG. 18.

In an illustrative embodiment, the corrugation of blank 418 is positioned to run in a transverse direction TD as shown in insert A in FIG. 17. It is within the scope of the present disclosure to establish each of the fold lines disclosed herein by using score lines, creases, perforations, or perforations and score lines or by using another suitable technique.

Blank 418 is folded in a manner similar to that shown in FIGS. 4 and 5 to produce the container 410 shown in FIG. 15. Once blank 418 is folded, primary canopy anchor flaps 451P, 452P, 451RP, and 452RP are used to retain container 410 in an erected condition as suggested in FIG. 15. First primary canopy anchor flap 451P is mated, e.g., adhered (using any suitable means), to right side wall 434 and second primary canopy anchor flap 452P is mated, e.g., adhered (using any suitable means), to left side wall 436 to form front end closure 428. Likewise, first primary canopy anchor flap 451RP is mated, e.g., adhered (using any suitable means), to right side wall 434 and second primary canopy anchor flap 452RP is mated, e.g., adhered (using any suitable means), to left side wall 436 to form rear end closure 430.

The border of container 410 further includes a rear end closure 430 coupled to a second end of floor 412 along a second end fold line 421 and formed to include a narrow-width rear end wall 450R coupled to the second end of floor 412 along second fold line 421 and a rear anchor strip 457R coupled to narrow-width rear end wall 450R along a second strip fold line 450R and to the right side wall 434. Rear anchor strip 457R includes a rear canopy 453R coupled to narrow-width rear end wall 450R along the second strip fold line 450R. Front and rear canopies 450, 450R cooperate to form a two-piece lid covering an opening into interior region 20 of container 410 as suggested in FIGS. 15 and 16. Rear anchor strip 457R further includes a rear first primary canopy anchor flap 451RP coupled to rear canopy 453R along a primary flap fold line 451RP and a rear first auxiliary canopy anchor flap 451RA coupled to rear first primary canopy anchor flap 451RP along an auxiliary flap fold line 3451RA. Rear auxiliary canopy anchor flap 451RA is mated to first rear end wall anchor flap 442 included in right side strip 424 and coupled to right side wall 434 to link rear anchor strip 457R to right side strip 424 to establish a second corner of the border.

Figure 19:
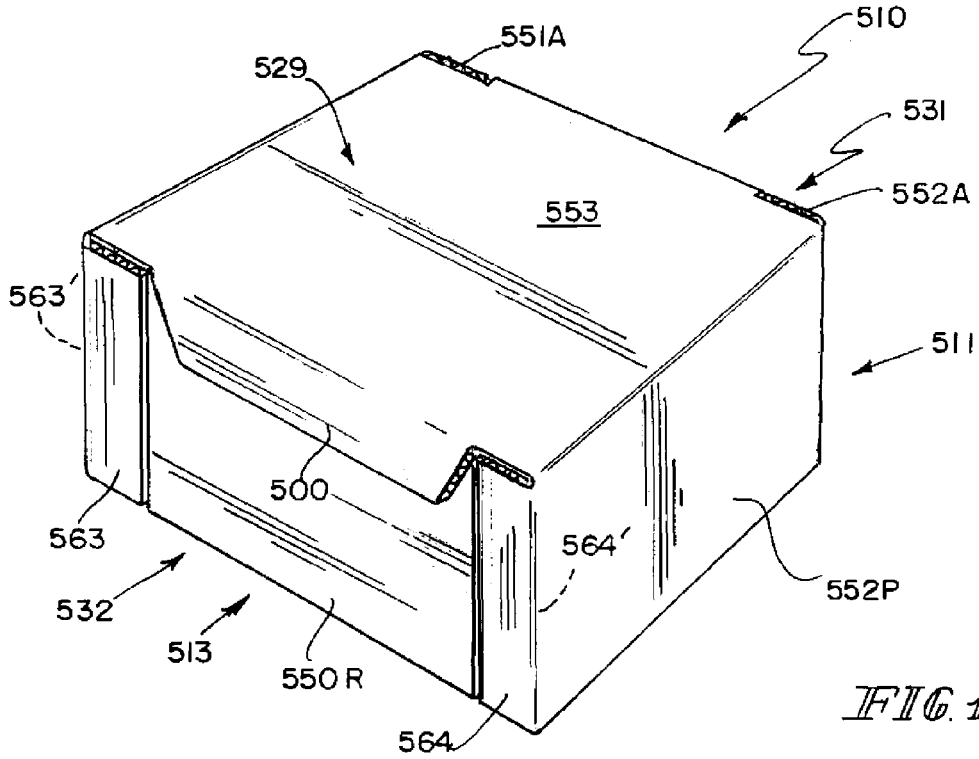
FIG. 19-21 relate to a fully enclosed container characterized by a single lid.
Figure 20:
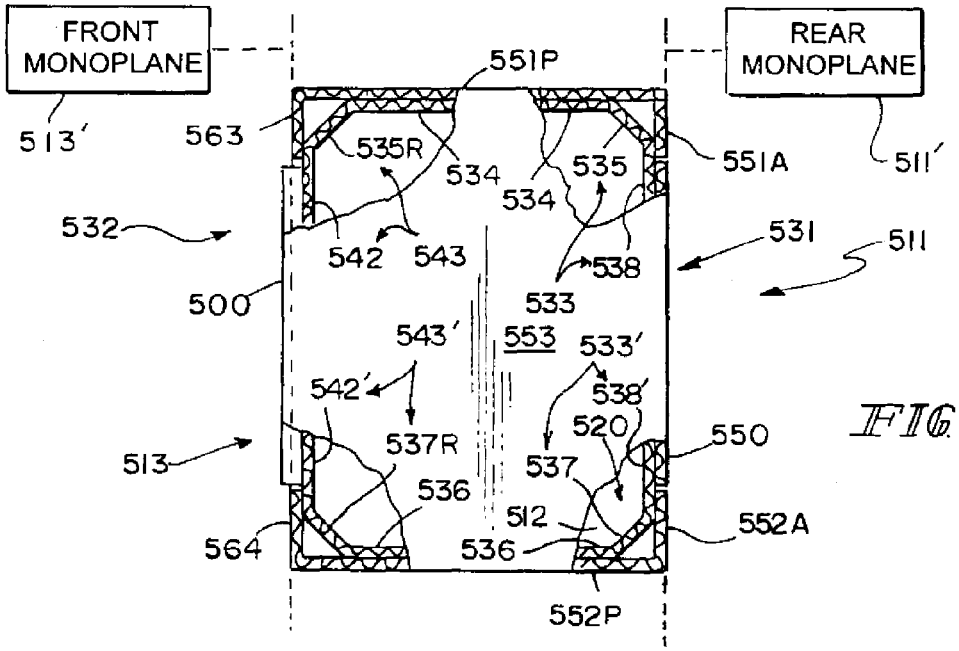
Figure 21:
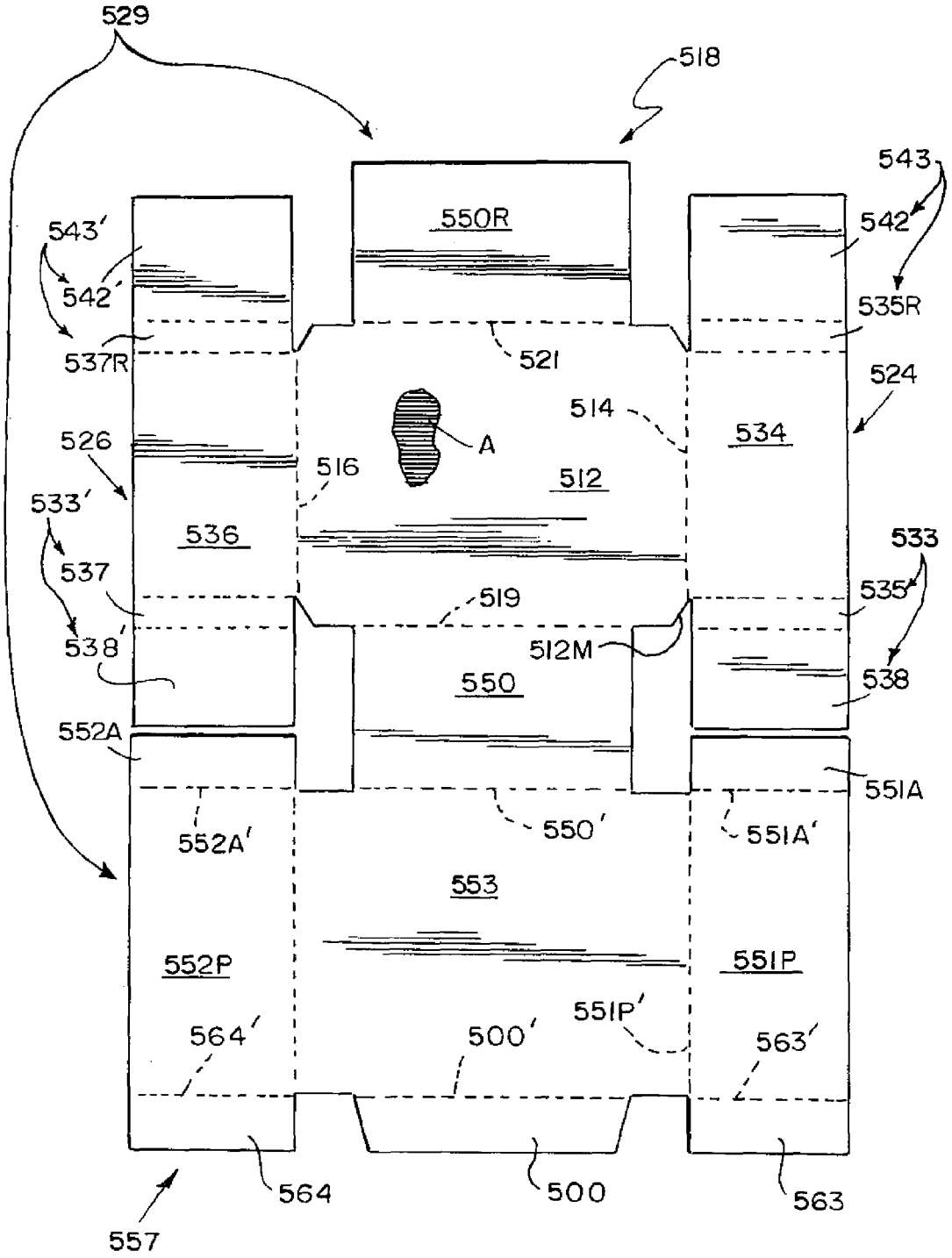

An article-transport container 510 in accordance with a fifth embodiment of the present disclosure is provided, as shown in FIGS. 19 and 20, for carrying various items and made using blank 518 shown in FIG. 21. Container 510 is configured to include front and rear monoplanar multipart end panels 511 and 513 as suggested in FIG. 20 when optional lid tab 500 is omitted. Each of end panels 511, 513 comprises multiple parts that cooperate to form an exterior surface that lies in a single plane (i.e., monoplane). As suggested in FIG. 20, the exterior surface of front end panel 511 lies in front monoplane 511. The exterior surface of rear end panel 513 lies in rear monoplane 513 as suggested in FIG. 20.

Container 510 is formed to include an interior region 520 as suggested in FIG. 20 for receiving various items such as fruits, vegetables, or any type of agricultural or meat product (not shown). Container 510 is well-suited to carry a wide variety of other items, articles, or products.

Container 510 is made, for example, from a blank 518 of corrugated material, as shown in FIG. 21. Blank 518 includes floor 512, a right side strip 524 appended to floor 512 along side fold line 514, a left side strip 526 appended to floor 512 along side fold line 516, and an end closure 529 appended to floor 512 along end fold lines 519 and 521. End closure 529 is configured to be folded to produce front and rear ends 531, 532 of container 510 as suggested in FIGS. 19 and 20. It is within the scope of the present disclosure to make blank 518 from a variety of materials including corrugated paperboard, folding carton, and solid fiber and other materials such as plastic sheeting and plastic corrugated.

Right side strip 524 includes a right side wall 534 as shown in FIG. 21. Right side wall 534 is appended to floor 512 along side fold line 514. Right side strip 524 also includes a first front end wall anchor flap 533 comprising a tab 538 and a front right corner bridge 535 interconnecting right side wall 534 and tab 538. Right side strip 524 also includes a first rear end wall anchor flap 543 comprising a tab 542 and a right rear corner bridge 533R interconnecting right side wall 534 and tab 542.

Left side strip 326 includes a left side wall 536 as shown in FIG. 21. Left side wall 536 is appended to floor 512 along side fold line 516. Left side strip 526 also includes a second front end wall anchor flap 533 comprising a tab 538 and a front left corner bridge 537 interconnecting left side wall 536 and tab 538. Left side strip 526 also includes a second rear end wall anchor flap 543 comprising a tab 542 and a left rear corner bridge 537R interconnecting left side wall 536 and tab 542.

End closure 529 includes a narrow-width front end wall 550 coupled to a front end of floor 512 along end fold line 519 and a front anchor strip 557 coupled to front end wall 550 along strip fold line 550 as suggested in FIG. 21. Front anchor strip 557 provides means for anchoring front end wall 550 to each of right and left side walls 534, 536 to establish rear end 532 of container 510. End closure 529 also includes a narrow-width rear end wall 550R coupled to one end of floor 512 along end fold line 521.

Front anchor strip 557 of end closure 529 includes a front canopy 553 coupled to end wall 550 along strip fold line 550, a first primary canopy anchor flap 551P coupled to one end of front canopy 553 along primary flap fold line 551P, and a second primary canopy anchor flap 552P coupled to an opposite end of front canopy 553 along primary flap fold line 552P as suggested in FIG. 21. Front anchor strip 557 also includes a first auxiliary canopy anchor flap 551A coupled to first primary canopy anchor flap 551P along auxiliary flap fold line 551A and a second auxiliary canopy anchor flap 552A coupled to second primary canopy anchor flap 552 along auxiliary flap fold line 552A as suggested in FIG. 21.

End closure 529 also includes a third auxiliary (rear-end) canopy anchor flap 563 coupled to first primary canopy anchor flap 551P along fold line 563 and a fourth auxiliary (rear-end) canopy anchor flap 564 coupled to second primary canopy anchor flap 552P along fold line 564. In an optional (but illustrated embodiment), end closure 529 also includes a lid tab 500 coupled to front canopy 553 along lid-tab fold line 500 as suggested in FIG. 21.

In an illustrative embodiment, the corrugation of blank 518 is positioned to run in a transverse direction TD as shown in insert A in FIG. 15. It is within the scope of the present disclosure to establish each of the fold lines 17 disclosed herein by using score lines, creases, perforations, or perforations and score lines or by using another suitable technique.

Blank 518 is folded in a manner similar to that shown in FIGS. 4 and 5 to produce the container 510 shown in FIG. 19. In the embodiment illustrated in FIGS. 19-21, front canopy is the only canopy and forms a one-piece lid covering an opening into interior region 520 of container 510 as suggested in FIG. 20. Once blank 518 is folded, primary canopy anchor flaps 551P and 552P are used to retain container 510 in an erected condition as suggested in FIG. 19. First primary canopy anchor flap 551P is mated, e.g., adhered (using any suitable means), to right side wall 534 and second primary canopy anchor flap 552P is mated, e.g., adhered (using any suitable means), to left side wall 536.

Front canopy 533 forms a one-piece lid covering an opening into the interior region of container 510 as suggested in FIGS. 14 and 20. The border of container 510 further includes a rear end wall 550R coupled to a second end of floor 51R along a second end fold line 521 and arranged to lie in spaced-apart substantially parallel relation to narrow-width front end wall 550. Front anchor strip 557 further includes a lid tab 500 coupled to front canopy 553 along a lid tab fold line 500 and mated to rear end wall 550R to retain front canopy 553 in a stationary position covering the opening in the interior region of container 510 as suggested in FIG. 19. First primary canopy anchor flap 551P is coupled to right side wall 534. First auxiliary canopy anchor flap 551A is oriented to lie in perpendicular relation to first primary canopy anchor flap 551P to define a right-angled exterior corner portion of the first corner of the border, first front end wall anchor flap 533 includes a tab and a front right corner bridge 534 interconnecting right side wall 534 and tab 538. Tab 538 of first front end wall anchor flap 533 mates with first auxiliary canopy anchor flap 551A. Front right corner bridge 535 is oriented to cooperate with each of tab 538 and right side wall 534 to define an obtuse included angle therebetween to define a mitered interior corner portion of the first corner of the border as suggested in FIG. 20. Floor 512 further includes a mitered edge 512*m* interconnecting the first end 519 of the floor and the first side 514 of floor 512. Mitered edge 512*m* is oriented to cooperate with each of the first end 519 and the first side 514 to define an obtuse included angle therebetween. Front right corner bridge 535 is arranged to confront the mitered edge 512*m* as suggested in FIG. 20.

Figure 22:
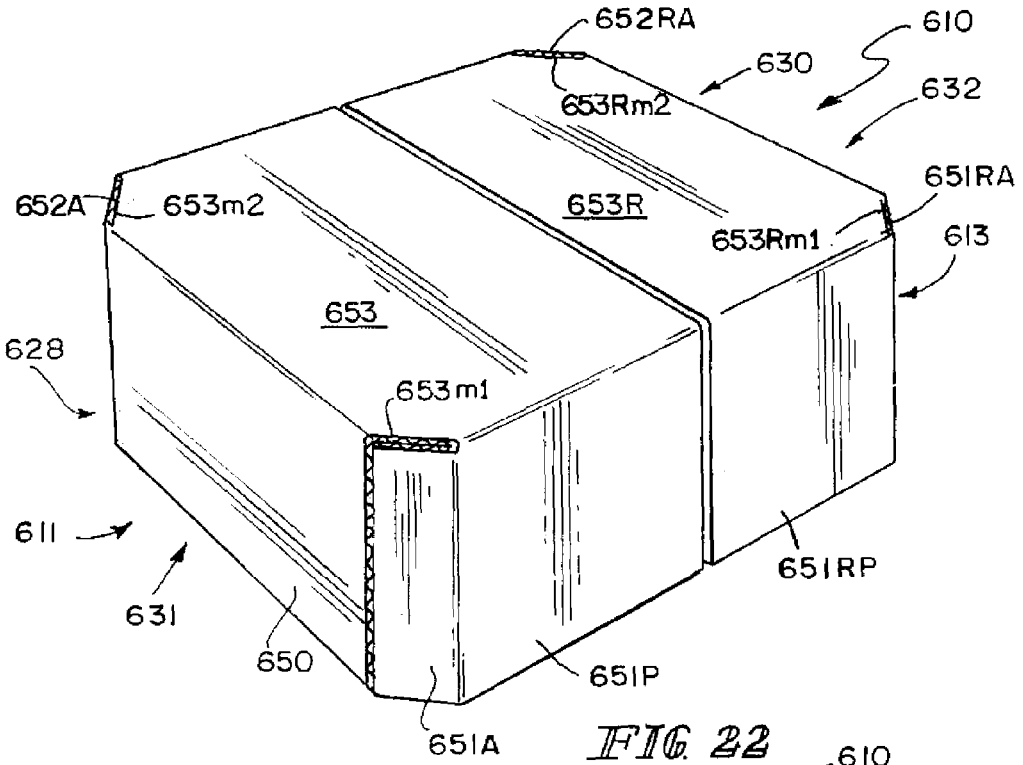
FIG. 22-25 relate to a fully enclosed octagon container characterized by a two-part lid and mitered inside and outside corner portions.
Figure 23:
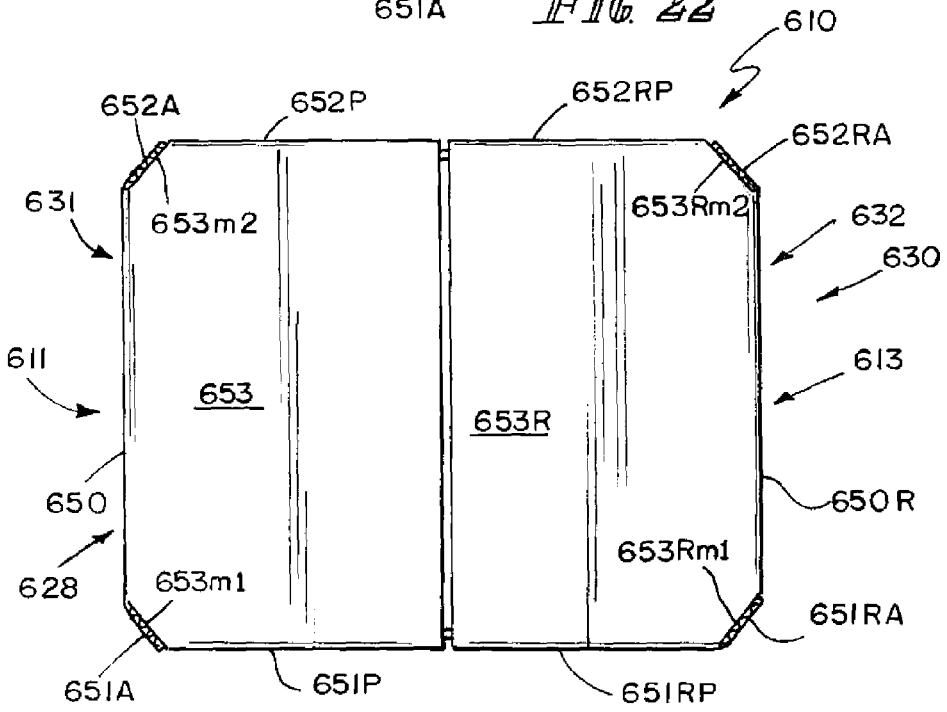
Figure 24:
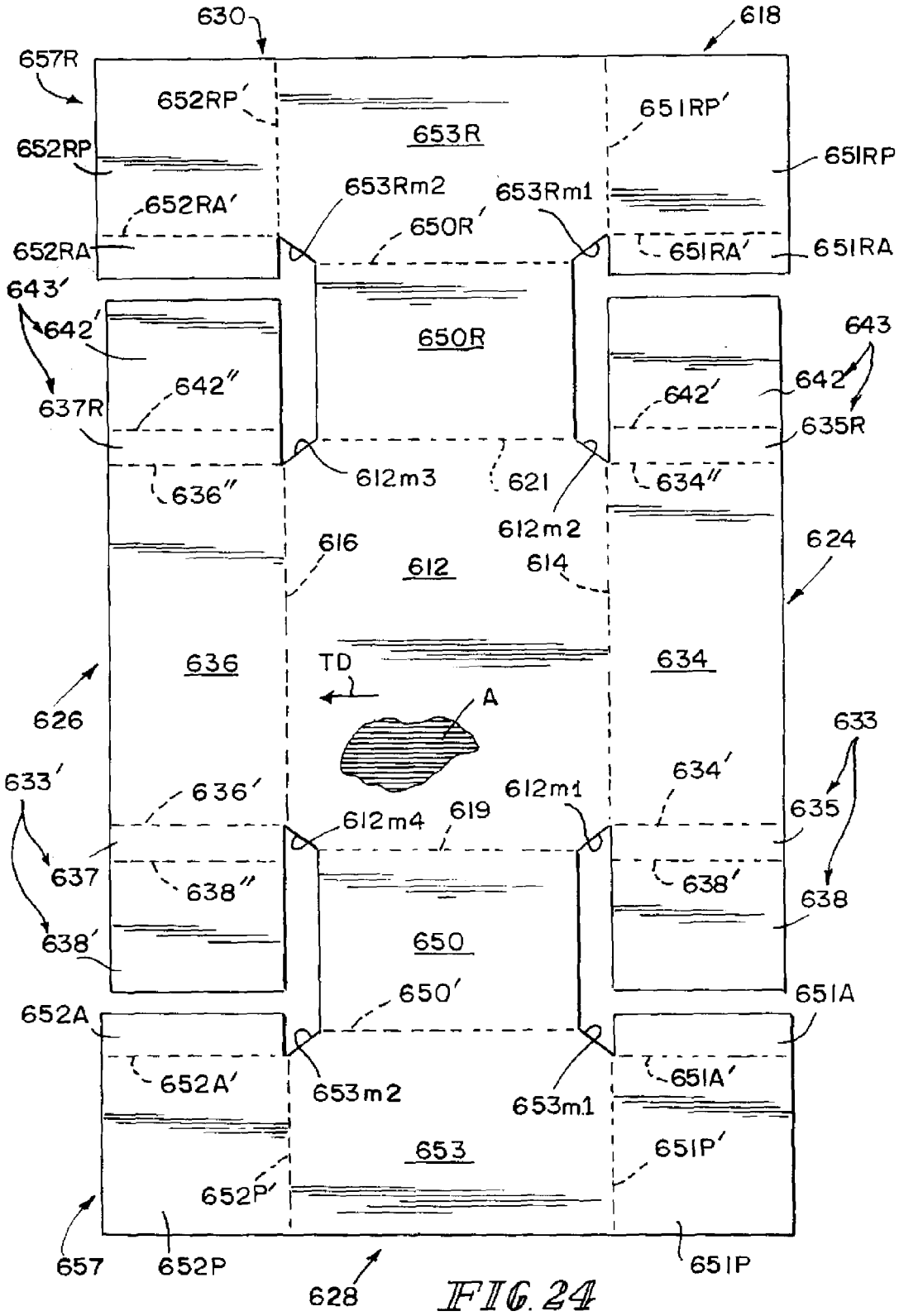

An article-transport container 610 in accordance with a sixth embodiment of the present disclosure is provided, as shown in FIGS. 22-25, for carrying various items and is made using blank 618 shown in FIG. 24. Container 610 is octagon-shaped and is configured to include front and rear multipart end panels 611 and 613 as suggested in FIG. 23.

Figure 25:
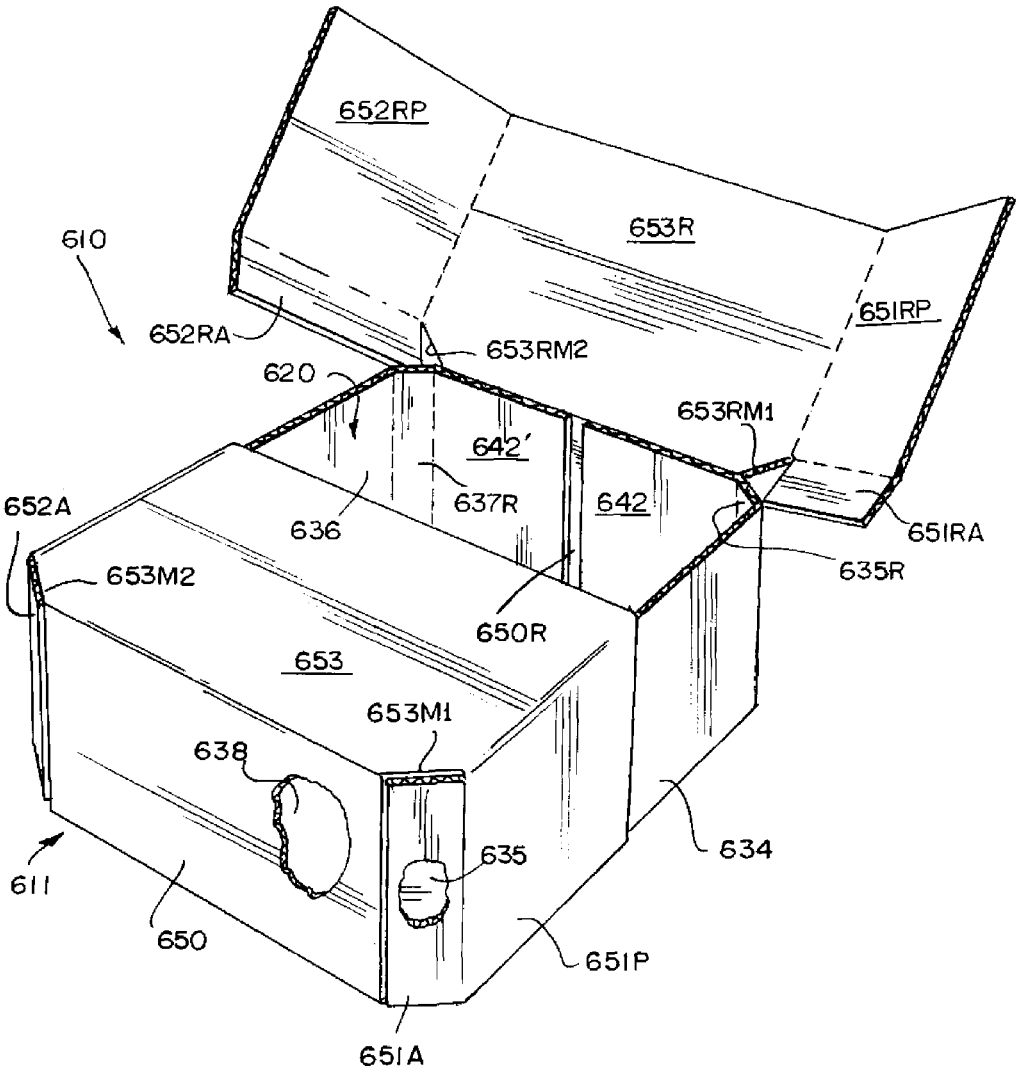

Container 610 is formed to include an interior region 620 as shown in FIG. 25 for receiving various items such as fruits, vegetables, or any type of agricultural or meat product (not shown). Container 610 is well-suited to carry a wide variety of other items, articles, or products.

Container 610 is made, for example, from a blank 618 of corrugated material, as shown in FIG. 24. Blank 618 includes floor 612, a right side strip 624 appended to floor 612 along side fold line 614, a left side strip 626 appended to floor 612 along side fold line 616, a front end closure 628 appended to floor 612 along first end fold line 619, and a rear end closure 630 appended to floor 612 along second end fold line 621. Rear end closure 630 is configured to be folded to produce a rear end 632 of container 610 as suggested in FIGS. 22 and 23. Front end closure 628 is configured to be folded to produce a front end 631 of container 610 as suggested in FIGS. 22 and 23. It is within the scope of the present disclosure to make blank 618 from a variety of materials including corrugated paperboard, folding carton, and solid fiber and other materials such as plastic sheeting and plastic corrugated.

Right side strip 624 includes a right side wall 634, as shown in FIG. 24. Right side wall 634 is appended to floor 612 along right side fold line 614. Right side strip 624 also includes a first front end wall anchor flap 633 coupled to right side wall 634 along a front anchor flap fold line 634 as shown in FIG. 24. First front end wall anchor flap 633 comprises a front tab 638 and a front right corner bridge 635 interconnecting right side wall 634 and front tab 638. Right side strip 624 also includes a first rear end wall anchor flap 643 coupled to right side wall 634 along a rear anchor flap fold line 634 as shown in FIG. 24. First rear end wall anchor flap 643 comprises a rear tab 642 and a rear right corner bridge 635R interconnecting right side wall 634 and rear tab 642.

Left side strip 626 includes a left side wall 636, as shown in FIG. 24. Left side wall 636 is appended to floor 612 along left side fold line 616. Left side strip 626 also includes a second front end wall anchor flap 633 comprising a front tab 638 and a front left corner bridge 637 interconnecting left side wall 636 and front tab 638. Left side strip 626 also includes a second rear end wall anchor flap 643 comprising a rear tab 642 and a rear left corner bridge 637R interconnecting left side wall 636 and rear tab 642.

Front end closure 628 includes a narrow-width front end wall 650 coupled to one end of floor 612 along first end fold line 619 and a front anchor strip 657 coupled to front end wall 650 along first strip fold line 650 as suggested in FIG. 24. Front anchor strip 657 provides means for anchoring front end wall 650 to each of right and left side walls 634, 636 to establish front end 631 of container 10.

Front anchor strip 657 includes a front canopy 653 coupled to front end wall 650 along first strip fold line 650, a first primary canopy anchor flap 651P coupled to one end of front canopy 653 along front primary flap fold line 651P, and a second primary canopy anchor flap 652P coupled to an opposite end of front canopy 653 along front primary flap fold line 652P as suggested in FIG. 24. Front anchor strip 657 also includes a first auxiliary canopy anchor flap 651A coupled to first primary canopy anchor flap 651P along front auxiliary flap fold line 651A' and a second auxiliary canopy anchor flap 652A coupled to second primary canopy anchor flap 652P along front auxiliary flap fold line 652A' as suggested in FIG. 24.

Rear end closure 630 includes a narrow-width rear end wall 650R coupled to an opposite end of floor 612 along second end fold line 621 and a rear anchor strip 657R coupled to rear end wall 650R along second strip fold line 650R as suggested in FIG. 24. Rear anchor strip 657R provides means for anchoring rear end wall 650R to each of right and left side walls 634, 636 to establish rear end 632 of container 610.

Rear anchor strip 657R includes a rear canopy 653R coupled to rear end wall 650R along second strip fold line 650R, a rear first primary canopy anchor flap 651RP coupled to one end of rear canopy 653R along rear primary flap fold line 651RP, and a rear second primary canopy anchor flap 652RP coupled to an opposite end of rear canopy 653R along rear primary flap fold line 652RP' as suggested in FIG. 24. Rear anchor strip 657R also includes a rear first auxiliary canopy anchor flap 651RA coupled to rear first primary canopy anchor flap 651 RP along rear auxiliary flap fold line 651RA' and a rear second auxiliary canopy anchor flap 652RA coupled to rear second primary canopy anchor flap 652RP along rear auxiliary flap fold line 652RA' as suggested in FIG. 24.

In an illustrative embodiment, the corrugation of blank 618 is positioned to run in a transverse direction TD as shown in insert A in FIG. 24. It is within the scope of the present disclosure to establish each of the fold lines disclosed herein by using score lines, creases, perforations, or perforations and score lines or by using another suitable technique.

Blank 618 is folded as shown, for example, in FIG. 25 to produce container 610 shown in FIG. 22. Once blank 618 is folded, primary canopy anchor flaps 651P, 652P, 651RP, and 652RP are used to retain container 610 in an erected condition as suggested in FIG. 22. First primary canopy anchor flap 651P is mated, e.g., adhered (using any suitable means), to right side wall 634 and second primary canopy anchor flap 652P is adhered (using any suitable means) to left side wall 636 to form front end closure 628. Likewise, first primary canopy anchor flap 651RP is mated, e.g., adhered (using any suitable means), to right side wall 634 and second primary canopy anchor flap 652RP is mated, e.g., adhered (using any suitable means), to left side wall 636 to form rear end closure 630.

Right side strip 624 includes a right side wall 634, a first front end wall anchor flap 638, and a front right corner bridge 635 as suggested in FIG. 24. Front right corner bridge 635 is coupled to right side wall 634 along fold line 634 and to first front end wall anchor flap 638 along fold line 638. Fold lines 634 and 638 are arranged to lie in spaced-apart parallel relation to one another in an illustrative embodiment as suggested in FIG. 24.

As suggested in FIG. 24, floor 612 is octagon-shaped and includes a front right mitered edge 612*m*1 arranged to interconnect end fold line 619 and side fold line 614. Mitered edge 6212*m*1 and each of first end fold line 619 and right side fold line 614 cooperate to define obtuse included angles therebetween as shown in FIG. 24. As an example, the obtuse included angles are about of about 135°. Front canopy 653 also includes a front right mitered edge 653*m*1 arranged to interconnect first strip fold line 650 and front auxiliary flap fold line 651A as shown in FIG. 24. When folded, front right corner bridge 635 is arranged to confront (e.g., abut or lie alongside) mitered edges 612*m*1 and 653*m*1 to establish a front (first) mitered inside corner as suggested in FIG. 22.

Right side strip 624 also includes a rear right corner bridge 635R as suggested in FIG. 24. Rear right corner bridge 635R is coupled to right side wall 634 along fold line 634 and to first rear end wall anchor flap 643 along fold line 642. Fold lines 634 and 642 are arranged to lie in spaced-apart parallel relation to one another in an illustrative embodiment as suggested in FIG. 24.

As suggested in FIG. 24, floor 612 also includes a rear right mitered edge 612*m*2 arranged to interconnect fold lines 621 and 634. Mitered edge 612*m*2 and each of fold lines 621 and 634 cooperate to define obtuse included angles therebetween as shown in FIG. 24. As an example, the obtuse included angles are about of about 135°. Rear canopy 653R also includes a rear right mitered edge 653R*m*1 arranged to interconnect fold lines 650R and 651RA as shown in FIG. 24. When folded, rear right corner bridge 635R is arranged to confront (e.g., abut or lie alongside) mitered edges 612*m*2 and 653R*m*1 to establish a rear (second) mitered inside corner as suggested in FIG. 23.

Left side strip 626 includes a left side wall 636, a rear second end wall anchor flap 643, and a rear left corner bridge 637R as suggested in FIG. 24. Rear left corner bridge 637R is coupled to left side wall 636 along fold line 636 and to second rear end wall anchor tab 642 along fold line 642. Fold lines 636 and 642 are arranged to lie in spaced-apart parallel relation to one another in an illustrative embodiment as suggested in FIG. 24.

As suggested in FIG. 24, floor 612 also includes a left rear mitered edge 612*m*3 arranged to interconnect fold lines 621 and 636. Mitered edge 612*m*3 and each of fold lines 616 and 621 cooperate to define obtuse included angles therebetween as shown in FIG. 24. As an example, the obtuse included angles are about of about 135°. Rear canopy 653R also includes a rear left mitered edge 653R*m*2 arranged to interconnect fold lines 650R and 652RA as shown in FIG. 24. When folded, rear left corner bridge 637R is arranged to confront (e.g., abut or lie alongside) mitered edges 612*m*3 and 653R*m*2 to establish a rear (third) mitered inside corner as suggested in FIG. 23.

Left side strip 626 includes a front left corner bridge 637 as suggested in FIG. 24. Front left corner bridge 637 is coupled to left side wall 636 along fold line 636 and to second front end wall anchor flap 638 along fold line 638. Fold lines 636 and 638 are arranged to lie in spaced-apart parallel relation to one another in an illustrative embodiment as suggested in FIG. 24.

As suggested in FIG. 24, floor 612 also includes a left front mitered edge 612*m*4 arranged to interconnect fold lines 619 and 636. Mitered edge 612*m*4 and each of fold lines 616 and 619 cooperate to define obtuse included angles of about 135° therebetween as shown in FIG. 24. Front canopy 653 also includes a front left mitered edge 653*m*2 arranged to interconnect fold lines 652A and 650 as shown in FIG. 24. When folded, front left corner bridge 637 is arranged to abut (or lie alongside) mitered edges 612*m*4 and 653*m*2 to establish a front (fourth) mitered inside corner portion as suggested in FIG. 23.

As suggested in FIGS. 22-24, first primary canopy anchor flap 651P is coupled to right side wall 634, first front end wall anchor flap 633 includes a front tab 638 and a front right corner bridge 635 interconnecting right side wall 634 and the front tab 638 of first front end wall anchor flap 633 mates with narrow-width front end wall 650 of front end closure 628. Front right corner bridge 635 is oriented to cooperate with each of front tab 638 and right side wall 634 to define an obtuse included angle therebetween to define a front (first) mitered interior corner portion of the border. First auxiliary canopy anchor flap 651A is mated with front right corner bridge 635 and arranged to cooperate with each of narrow-width front end wall 650 and first primary canopy anchor flap 651P to define an obtuse included angle therebetween to define a front (first) mitered exterior corner portion of the border.

Floor 612 includes a front right mitered edge 612*m*1 arranged to interconnect the side and end fold lines 619, 614 and to cooperate with each of the right side and first end fold lines 619, 614 to define an obtuse included angle therebetween as suggested in FIG. 24. Front canopy 653 includes a front right mitered edge 653*m*1 arranged to interconnect first strip fold line 650, primary flap fold line 651P, and auxiliary flap fold line 651A as shown in FIG. 24. Front right corner bridge 635 is arranged to confront both of front right mitered edges 612*m*1, 653*m*1 of floor 212 and front canopy 653.

Customers are always seeking stronger packages that use lighter weight material combinations to be able to reduce their packaging cost, while delivering a superior product to the market. Corrugated companies have responded over the years by providing structures of increasing complexity, particularly in the corner structural areas where the stacking strength of the package is often concentrated. In a number of examples, these strategies have greatly increased the strength of the package, but this goal has come at a cost, in that the number of layers of corrugated board in the package have increased between the product on the inside of the carton and the outside dimension of the package. This can have a negative effect on palletization and performance, as pallet fit can be compromised with the added layers, particularly when multiple packages are arranged on a pallet. The added layers of material can result in overhang, which not only compromises the stacking strength of the container, but may result in damage to the product. In addition, proper package fit with primary packages may be made difficult when adding additional layers of material and trying to hold firm on an established outside box dimension. Therefore, it would be desirable to have a box design that would offer the structural strength and design attributes, without the added layers of material between the product and outside of the package.

In accordance with the present disclosure, oversized slots between side or end walls and the corresponding minor flaps that fold to the inside of the container, as well as the removal of the exterior flap offsets from the end or side flap areas allow the exterior wraparound corner flap to fit and attach directly to the inside minor flap, rather than the outside wall of the container. This effectively allows this wraparound flap component to reside inward of the end wall, on the same plane as the end wall, making it flush with the end wall, and effectively eliminating one layer of board from each end or side of the container. While this may seem like a trivial gain, effectively eliminating a layer of board on each side or end of the package can gain the customer between ⅜ inch and ⅝ inch per box. If there are several boxes per row arranged on a pallet, this gain can be significant and a welcomed improvement in keeping the boxes inside the edge of the pallet. It also minimizes the opportunity that the flap will catch, snag, or pull open due to contact with mechanical handling devices, such as conveyors and transfer mechanisms, or through the contact with an exterior flap of a neighboring container when handled or depalletized.

The invention claimed is:

1. An article-transport container comprising a floor having two sides and two ends, and a border coupled to the floor and arranged to cooperate with the floor to form an interior region adapted to contain articles, the border including a right side strip coupled to a first side of the floor along a right side fold line and a front end closure coupled to a first end of the floor along a first end fold line and formed to include a narrow-width front end wall coupled to a first end of the floor along the first end fold line and a front anchor strip coupled to the narrow-width front end wall along a first strip fold line and to the right side strip, wherein the right side strip includes a right side wall coupled to the one side of the floor along the right side fold line and a first front end wall anchor flap coupled to the right side wall along a front anchor flap fold line, the front anchor strip includes a front canopy coupled to the narrow-width front end wall along the first strip fold line, a first primary canopy anchor flap coupled to the front canopy along a primary flap fold line, and a first auxiliary canopy anchor flap coupled to the first primary canopy anchor flap along an auxiliary flap fold line, and the first auxiliary canopy anchor flap is mated to the first front end wall anchor flap to link the front anchor strip to the right side strip to establish a first corner of the border, wherein the border further includes a rear end closure coupled to a second end of the floor along a second end fold line and formed to include a narrow-width rear end wall coupled to the second end of the floor along the second fold line and a rear anchor strip coupled to the narrow-width rear end wall along a second strip fold line and to the right side wall, the rear anchor strip includes a rear canopy coupled to the narrow-width rear end wall along the second strip fold line, and the front and rear canopies cooperate to form a two-piece lid covering an opening into the interior region of the container, and wherein the floor further includes a front right mitered edge interconnecting the first end of the floor and the first side of the floor, the mitered edge is oriented to cooperate with each of the first end and the first side to define an obtuse included angle therebetween, and a portion of the first front end wall anchor flap is arranged to mate with the front right mitered edge.

2. The container of claim 1, wherein the first front end wall anchor flap includes a front tab and a front right corner bridge interconnecting the right side wall and the front tab and the front right corner bridge mates with the front right mitered edge of the floor.

3. The container of claim 2, wherein the front tab mates with the first auxiliary corner anchor flap.

4. The container of claim 2, wherein the front right corner bridge is oriented to cooperate with each of the front tab and the right side wall to define an obtuse included angle therebetween to define a mitered interior corner portion of the border.

5. The container of claim 4, wherein the first auxiliary canopy anchor flap is oriented to cooperate with each of the narrow-width front end wall and the first primary canopy anchor flap to define an obtuse included angle therebetween to define a mitered exterior corner portion of the border alongside the mitered interior corner portion of the border.

6. An article-transport container comprising a floor having two sides and two ends and a border coupled to the floor and arranged to cooperate with the floor to form an interior region adapted to contain articles, the border including a right side strip coupled to a first side of the floor along a right side fold line and a front end closure coupled to a first end of the floor along a first end fold line and formed to include a narrow-width front end wall coupled to a first end of the floor along the first end fold line and a front anchor strip coupled to the narrow-width front end wall along a first strip fold line and to the right side strip, wherein the right side strip includes a right side wall coupled to the one side of the floor along the right side fold line and a first front end wall anchor flap coupled to the right side wall along a front anchor flap fold line, the front anchor strip includes a front canopy coupled to the narrow-width front end wall along the first strip fold line, a first primary canopy anchor flap coupled to the front canopy along a primary flap fold line, and a first auxiliary canopy anchor flap coupled to the first primary canopy anchor flap along an auxiliary flap fold line, and the first auxiliary canopy anchor flap is mated to the first front end wall anchor flap to link the front anchor strip to the right side strip, wherein the floor further includes a front right mitered edge interconnecting the first end of the floor and the first side of the floor, the front right mitered edge is oriented to cooperate with each of the first end and the first side to define an obtuse included angle therebetween, the first front end wall anchor flap includes a front tab and a front right corner bridge interconnecting the right side wall and the front tab, the front tab mates with the narrow-width front end wall of the front end closure and lies in perpendicular relation to the right side wall, and the front right corner bridge is arranged to confront the front right mitered edge of the floor to establish a first mitered inside corner of the border.

7. The container of claim 6, wherein the first auxiliary canopy anchor flap is arranged to mate with the right front corner bridge and extend from a right edge of the narrow-width front end wall to the auxiliary flap-fold line to establish a first mitered outside corner of the border alongside the first mitered inside corner of the border.

8. The container of claim 7, wherein the border has an octagonal shape and comprises, in series, first, second, third, fourth, fifth, sixth, seventh, and eighth panels, the first panel is defined by the narrow-end front wall of the front end closure, the second panel is defined by the auxiliary canopy anchor flap of the front anchor strip, and a front portion of the third panel is defined by the primary canopy anchor flap of the front anchor strip.

9. The container of claim 8, wherein the border further includes a rear end closure coupled to a second end of the floor along a second end fold line and formed to include a narrow-width rear end wall coupled to the second end of the floor along the second end fold line and a rear anchor strip coupled to the narrow-width rear end wall along a second strip fold line and to the right side strip, wherein the right side strip further includes a first rear end wall anchor flap coupled to the right side wall along a rear anchor flap fold line, the rear anchor strip includes a rear canopy coupled to the narrow-width rear end wall along the second strip fold line, a rear first primary canopy anchor flap coupled to the rear canopy along a rear primary flap fold line, and a rear first auxiliary canopy anchor flap coupled to the rear first primary canopy anchor flap along a rear auxiliary flap fold line, and the rear auxiliary canopy anchor flap is mated to the first rear end wall anchor flap to link the rear anchor strip to the right side strip, wherein the floor further includes a rear right mitered edge interconnecting the second end of the floor and the first side of the floor, the rear right mitered edge is oriented to cooperate with each of the second end and the first side to define an obtuse included angle therebetween, the first rear end wall anchor flap includes a rear tab and a rear right corner bridge interconnecting the right side wall and the rear tab, the rear tab mates with the narrow-width rear end wall of the rear end closure and lies in perpendicular relation to the right side wall, and the rear right corner bridge is arranged to confront the rear right mitered edge of the floor to establish a second mitered inside corner of the border, and wherein the rear first auxiliary canopy anchor flap is arranged to mate with the right rear corner bridge and extend from a right edge of the narrow-width rear end wall of the rear auxiliary flap-fold line to establish a second mitered outside corner of the border alongside the second mitered inside corner of the border, and wherein a rear portion of the third panel is defined by the rear first primary canopy anchor flap, the fourth panel is defined by the rear first auxiliary canopy anchor flap, and the fifth panel is substantially parallel to the first panel and is defined by the rear canopy.

10. The container of claim 6, wherein the front right corner bridge is interposed between the front right mitered edge of the floor and the first auxiliary canopy anchor flap.

11. The container of claim 10, wherein the front right corner bridge includes an interior surface mating with the front right mitered edge of the floor and facing toward the interior region and an exterior surface mating with an interior surface of the first auxiliary canopy anchor flap and facing away from the interior region.

12. The container of claim 11, wherein the front canopy includes a front right mitered edge arranged to lie in spaced-apart parallel relation to the front right mitered edge of the floor and to mate with the interior surface of the front right corner bridge.

13. The container of claim 12, wherein the front right mitered edge of the floor is arranged to interconnect the side and first end fold lines and the front right mitered edge of the front canopy is arranged to interconnect the primary flap and first strip fold lines.

14. The container of claim 12, wherein the front right mitered edge of the floor is arranged to interconnect the first end fold line and the front anchor flap fold line and the front right mitered edge of the front canopy is arranged to interconnect the first strip fold line and the auxiliary flap fold line.

15. The container of claim 10, wherein the front right mitered edge of the floor is arranged to interconnect the side and first end fold lines, the front canopy of the front anchor strip includes a front right mitered edge arranged to lie in spaced-apart parallel relation to the front right mitered edge of the floor and to interconnect the primary flap and first strip fold lines, and the front right corner bridge is also arranged to confront the front right mitered edge of the front canopy.

16. The container of claim 15, wherein the front right mitered edge of the floor is arranged to interconnect the first end fold line and the front anchor flap fold line.

17. The container of claim 15, wherein the front right mitered edge of the front canopy is oriented to cooperate with each of the primary flap and first strip fold lines to define the obtuse included angle therebetween.

18. The container of claim 17, wherein the front right corner bridge includes a lower end mating with the front right mitered edge of the floor and an upper end mating with the front right mitered edge of the front canopy.

19. The container of claim 17, wherein the obtuse included angle is about 135° .

20. The container of claim 15, wherein the narrow-width front end wall includes a right edge arranged to lie in perpendicular relation to each of the floor and the front canopy and to interconnect the front right mitered edge of the floor and the front canopy.

21. The container of claim 6, wherein the border includes an inner fence extending along the right side fold line associated with the floor, the front right mitered edge of the floor, and the first end fold line associated with the floor, and an outer fence arranged to lie alongside the inner fence to locate the inner fence between the floor and the outer fence, the inner fence comprises, in series, the right side wall, the front right corner bridge, and the front tab, and the outer fence comprises, in series, the first primary canopy anchor flap, the first auxiliary canopy anchor flap, and the narrow-width front end wall.

22. The container of claim 21, wherein the front right corner bridge is interposed between the front right mitered edge of the floor and the first auxiliary canopy anchor flap.

23. The container of claim 22, wherein the front right corner bridge includes an interior surface mating with the front right mitered edge of the floor and facing toward the interior region and an exterior surface mating with an interior surface of the first auxiliary canopy anchor flap and facing away from the interior region.

24. The container of claim 22, wherein the front right mitered edge of the floor is arranged to interconnect the side and first end fold lines, the front canopy of the front anchor strip includes a front right mitered edge arranged to lie in spaced-apart parallel relation to the front right mitered edge of the floor and to interconnect the primary flap and first strip fold lines, and the front right corner bridge is also arranged to confront the front right mitered edge of the front canopy.

25. The container of claim 24, wherein the front right mitered edge of the floor is arranged to interconnect the first end fold line and the front anchor flap fold line.

26. The container of claim 6, wherein the right side wall has a first height as measured along the right side fold line, the first primary canopy anchor flap has a second height as measured along the auxiliary flap fold line, and the first height is about equal to the second height.

27. An article-transport container comprising a floor having two sides and two ends and a border coupled to the floor and arranged to cooperate with the floor to form an interior region adapted to contain articles, the border including a right side strip coupled to a first side of the floor along a right side fold line and a front end closure coupled to a first end of the floor along a first end fold line and formed to include a narrow-width front end wall coupled to a first end of the floor along the first end fold line and a front anchor strip coupled to the narrow-width front end wall along a first strip fold line and to the right side strip, wherein the right side strip includes a right side wall coupled to the one side of the floor along the right side fold line and a first front end wall anchor flap coupled to the right side wall along a front anchor flap fold line, the front anchor strip includes a front canopy coupled to the narrow-width front end wall along the first strip fold line, a first primary canopy anchor flap coupled to the front canopy along a primary flap fold line, and a first auxiliary canopy anchor flap coupled to the first primary canopy anchor flap along an auxiliary flap fold line, and the first auxiliary canopy anchor flap is mated to the first front end wall anchor flap to link the front anchor strip to the right side strip to establish a first corner of the border, wherein the first primary canopy anchor flap is coupled to the right side wall, the first front end wall anchor flap includes a front tab and a front right corner bridge interconnecting the right side wall and the front tab of the first front end wall anchor flap mates with the narrow-width front end wall of the front end closure, the front right corner bridge is oriented to cooperate with each of the front tab and the right side wall to define an obtuse included angle therebetween to define a mitered interior corner portion of the first corner of the border, and the first auxiliary canopy anchor flap is mated with the front right corner bridge and arranged to cooperate with each of the narrow-width front end wall and the first primary canopy anchor flap to define an obtuse included angle therebetween to define a mitered exterior corner portion of the border.

28. The container of claim 27, wherein the floor includes a front right mitered edge arranged to interconnect the right side and first end fold lines and to cooperate with each of the right side and first end fold lines to define an obtuse included angle therebetween, the front canopy includes a front right mitered edge arranged to interconnect the first strip fold line, the primary flap fold line, and the auxiliary flap fold line, and the front right corner bridge is arranged to confront both of the front right mitered edges of the floor and the front canopy.

* * * * *